US006520484B1

(12) United States Patent
Shimizu et al.

(10) Patent No.: US 6,520,484 B1
(45) Date of Patent: Feb. 18, 2003

(54) HOISTING APPARATUS

(75) Inventors: Toshiyuki Shimizu, Higashiosaka (JP); Yasuhiro Miyazaki, Nishikanbara-gun (JP); Shiro Nakajima, Amagasaki (JP)

(73) Assignee: Matsushita Electric Works, LTD, Osaka (JP)

( * ) Notice: Subject to any disclaimer, the term of this patent is extended or adjusted under 35 U.S.C. 154(b) by 0 days.

(21) Appl. No.: 09/716,996

(22) Filed: Nov. 22, 2000

(30) Foreign Application Priority Data

Sep. 29, 2000 (JP) ..... 2000-300886

(51) Int. Cl.[7] ..... B66D 1/48
(52) U.S. Cl. ..... 254/276; 254/382
(58) Field of Search ..... 254/276, 278, 254/329, 382

(56) References Cited

U.S. PATENT DOCUMENTS 4,125,908 A * 11/1978 Vail et al. ..... 104/94
4,243,147 A * 1/1981 Twitchell et al. ..... 104/172.1
4,944,056 A * 7/1990 Schroeder et al. ..... 5/85.1
5,263,687 A * 11/1993 Garbiso ..... 248/327
5,361,565 A * 11/1994 Bayer ..... 254/270
5,556,195 A * 9/1996 Glebe ..... 248/328
5,694,654 A * 12/1997 Roy ..... 5/83.1
6,241,215 B1 * 6/2001 Gersemsky et al. ..... 254/342

FOREIGN PATENT DOCUMENTS

JP 6290626 10/1994
JP 10241448 9/1998

* cited by examiner

*Primary Examiner*—Emmanuel Marcelo
(74) *Attorney, Agent, or Firm*—Rader Fishman & Grauer

(57) ABSTRACT

A hoisting apparatus is provided to facilitate maintenance of a load such as luminaires used at high elevations under safe working conditions. The apparatus comprises at least one cable, a load holder for holding the load, a base secured to a ceiling of a structure, and coupled to the load holder through the cable, and a drive unit for moving the load holder up and down by use of the cable between a top position where the load holder is located adjacent to the base, and a bottom position where the load holder is spaced from the base. The load holder has cable-length adjust unit for adjusting a length of the cable to stop the load holder at a desired position between the top and bottom positions.

28 Claims, 22 Drawing Sheets

HOISTING APPARATUS

BACKGROUND OF THE INVENTION

1. Field of the Invention

The present invention relates to a hoisting apparatus for load such as luminaires used at high elevations, and particularly a hoisting apparatus characterized in that a descending position of the load can be readily and safely adjusted to facilitate maintenance works of the load.

2. Disclosure of the Prior Art

In high-ceilinged structures such as concert hall, gymnasium, and convention hall, a hoisting apparatus for luminaire has been utilized to readily perform maintenance works of the luminaire operated in the vicinity of the ceiling. The hoisting apparatus is mainly composed of a hoisting part for supporting the luminaire, drive unit for moving the hoisting part up and down by use of cable(s), and a base secured to the ceiling, on which the drive unit is mounted.

In this kind of the hoisting apparatus, when the hoisting apparatus is mounted to the ceiling of the structure, an optimum length of the cable is usually determined according to the height of the ceiling. Thereby, the hoisting part can be moved up and down between a top position where the luminaire is operated, and a bottom position where the maintenance of the luminaire is performed.

However, when it is needed to change the bottom position of the hoisting part for layout change after the optimum length of the cable is determined once, an operation of changing or adjusting the length of the cable must be performed at the ceiling again. It is impractical to often perform such a bother operation at high elevations. On the other hand, when the operation is not performed, there are problems that the maintenance works of the luminaire can not be safely performed, and the maintenance efficiency lowers.

SUMMARY OF THE INVENTION

From the above viewpoints, a primary object of the present invention is to provide a hoisting apparatus for load characterized in that the length of cable(s) can be readily adjusted such that a descending position of the load matches a position adequate for maintenance works of the load without dangerous operations at high elevations, to thereby facilitate the maintenance works of the load under the safe working condition.

That is, the hoisting apparatus comprises at least one cable, a load holder for holding the load, a base secured to a ceiling, and coupled to the load holder through the cable, and a drive unit for moving the load holder up and down by use of the cable between a top position where the load holder is located adjacent to the base and a bottom position where the load holder is spaced from the base by a distance. In the present invention the load holder has a cable-length adjust unit for adjusting a length of the cable to stop the load holder at a desired position between the top and bottom positions.

It is preferred that one end of the cable is connected to the load holder, and the opposite end of the cable is connected to the drive unit mounted to the base.

It is preferred that the cable is composed of a pair of strip cables. In this case, it is also preferred that the strip cables mutually extend in a substantially same plane.

It is preferred that the cable-length adjust unit is provided with a winding shaft rotatably supported in the load holder and a rotation-inhibiting member for inhibiting the rotation of the winding shaft, and one end of the cable is connected to the winding shaft, so that a desired amount of the cable can be wound on the winding shaft. In this case, it is preferred that the winding shaft is formed with an operation part, which is accessible from outside of the load holder to adjust a winding amount of the cable on the winding shaft, and an engagement part, to which the rotation-inhibiting member can be engaged to prevent unwinding of the cable from the winding shaft. In addition, it is particularly preferred that the winding shaft can be divided into a pair of elongate pieces along its axial direction, and one end of the cable is caught between the elongate pieces.

It is preferred that the drive unit is mounted to the base, and comprises a winding drum, to which one end of the cable is connected, and an electric motor for rotating the winding drum.

It is preferred that the base has a second cable-length adjust unit for adjusting an amount of the cable to be unwound from the winding drum. In this case, it is preferred that the second cable-length adjust unit comprises a rotating body, which is rotated at a rotation amount of less than one turn according to the rotation of the winding drum when the load holder is moved from the top position to the bottom position, and a stop switch for automatically stopping a supply of electric power to the motor when the rotating body reaches the rotation amount.

It is preferred that the rotating body is a final gear coupled to the winding drum through a reduction-gearing unit, and the final gear has a knob used to disengage the final gear from the reduction-gearing unit and change the rotation amount of the rotating body. In this case, it is also preferred that the knob of the rotating body is exposed to be accessible from outside of the base. Moreover, it is preferred that the final gear receives a spring bias in its axial direction, and is moved in the axial direction against the spring bias to disengage the final gear from the reduction-gearing unit and change the rotation amount of the rotating body.

In addition, it is preferred that the hoisting apparatus of the present invention comprises a cable receiving member provided to receive the cable at a position between the winding drum and the load holder, an elastic body for movably supporting the cable receiving member according to a change in tension of the cable, and a first switch for automatically stopping a supply of electric power to the motor when a positional displacement of the cable receiving member is caused by an elastic deformation of the elastic body according to an increase in tension of the cable. In this case, it is particularly preferred that the cable receiving member is a sheave for turning the cable unwound from the winding drum toward the load holder, the elastic body is a spring, and the supply of electric power to the motor is stopped when the sheave is displaced downward by an elastic deformation of the spring.

It is preferred that the hoisting apparatus of the present invention comprises brake unit for inhibiting a rotation of a drive shaft of the motor when the load holder is in the top position. In this case, it is particularly preferred that the brake unit comprises a pressure member of an elastic material, which is elastically deformed by the load holder when the load holder is in the top position, so that the deformed pressure member inhibits the rotation of the drive shaft of the motor by friction.

It is preferred that the hoisting apparatus of the present invention comprises a cable receiving member for turning the cable unwound from the winding drum toward the load holder, and a second switch for automatically stopping a supply of electric power to the motor when the second switch is activated by the cable itself extending between the winding drum and the cable receiving member. In this case, it is preferred that the second switch is disposed in such a position that when a slack of the cable is caused by a decrease in tension of the cable, the second switch is activated by the cable itself under the slack condition. Moreover, it is preferred that the second switch is disposed in such a position that when unwinding of the cable from the winding drum is finished, the second switch is activated by the cable itself extending between the cable receiving member and the winding drum.

In addition, it is preferred that the winding drum has a cable catching portion for catching one end of the cable, and an arcuate portion configured to enhance winding of the cable on the winding drum only when the winding drum rotates in one direction.

It is preferred that the reduction-gearing unit comprises a plurality of reduction gears engaged mutually, and a bearing unit for supporting rotation shafts of the reduction gears, and the bearing unit is provided with a plurality of projections of different heights, each of which has at its top end a concave for receiving the rotation shaft of the reduction gear, and a single supporting member, which is used only to support one of the reduction gears in cooperation with the projection of the greatest height, so that the remaining reduction gears are supported by the other projections without using an additional supporting member.

It is preferred that the drive unit comprises a winding drum, to which one end of the cable is connected, and a DC motor for rotating the winding drum, which comprises a permanent magnet and a rectifier brush. In this case, it is preferred that the hoisting apparatus of the present invention comprises a reduction-gearing unit for transmitting an output power of the DC motor to the winding drum, and the reduction-gearing unit has a self-lock mechanism for inhibiting transmission of a rotation of the winding drum to the DC motor, which is composed of a worm gear and a worm wheel.

In a preferred embodiment of the present invention, the load holder has a case for housing the cable-length adjust unit therein, which has a pair of guide projections formed such that the cable extends from the cable-length adjust unit in the case toward the base through a clearance between the guide projections, and at least one of the guide projections has a rounded tip.

In a further preferred embodiment of the present invention, the load holder is coupled to the base by use of plural cables, and has a case for housing the cable-length adjust unit therein, and the case has protrusions extending outside from its rim to prevent a situation in which the load holder suspended from the base by the cables is rotated about a horizontal axis by mistake to form a kink in the cables. In this case, it is preferred that the base has a housing with a concave into which the case is fitted when the load holder is in the top position, and each of the protrusions has an arcuate tip adapted to guide the case into the concave.

These and still other objects and advantages will become apparent from the following detail description of the invention.

DETAILED DESCRIPTION OF PREFERRED EMBODIMENTS

Referring to attached drawings, a hoisting apparatus for load according to a preferred embodiment of the present invention is explained below in detail. As to the load, there is no limitation. For example, the load comprises articles such as luminaires, cameras for crime prevention, fire alarm, and curtains, which are used at high elevations and lifted down from the high elevations for maintenance.

Figure 1:
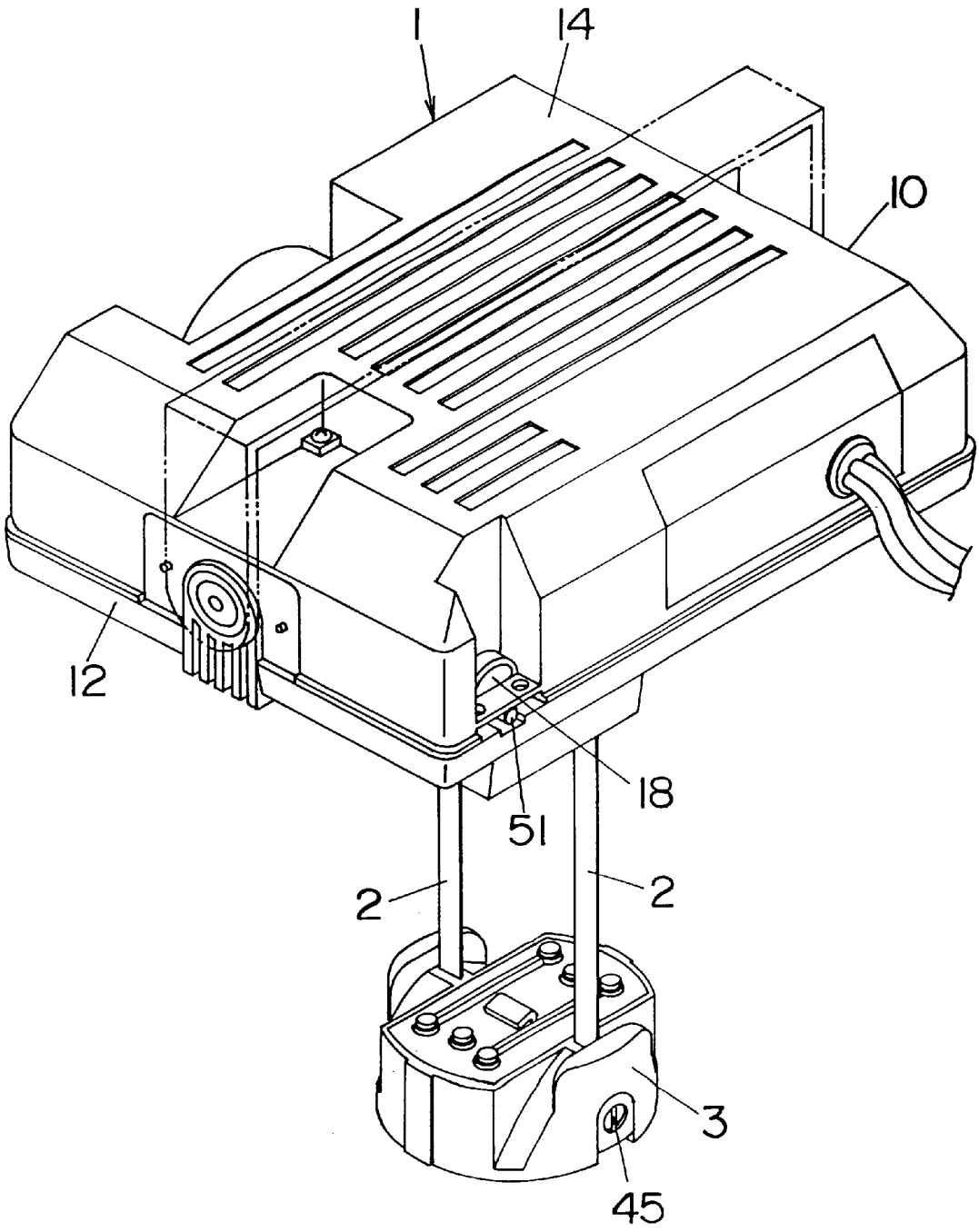
FIG. 1 is a perspective view of a hoisting apparatus for luminaire according to an embodiment of the present invention.

A perspective view of the hoisting apparatus of this embodiment is shown in FIG. 1. This hoisting apparatus comprises a pair of strip cables 2, a load holder 3 to which a luminaire can be attached, and a base 1 secured to a ceiling of a structure. The load holder 3 is coupled with the base 1 through the cables 2.

It is preferred that the cables 2 are made of a metal material having high stiffness. When the number of the cables is two or more, there is an advantage that even if one of the cables is accidentally broken, the load holder is safely caught by the remaining cable(s).

Figure 2:
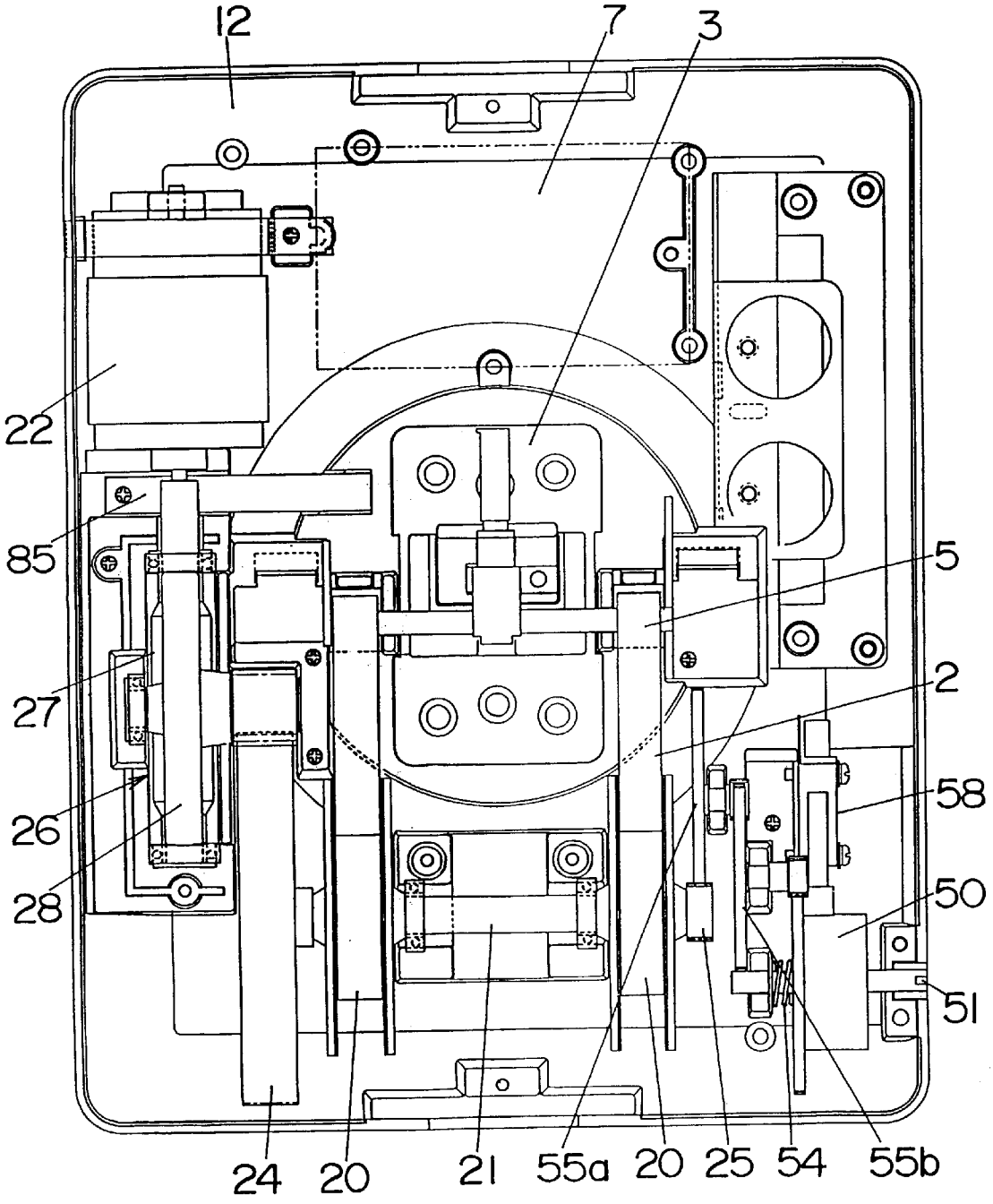
FIG. 2 is a schematic plan view illustrating inner workings of a base of the hoisting apparatus.
Figure 3:
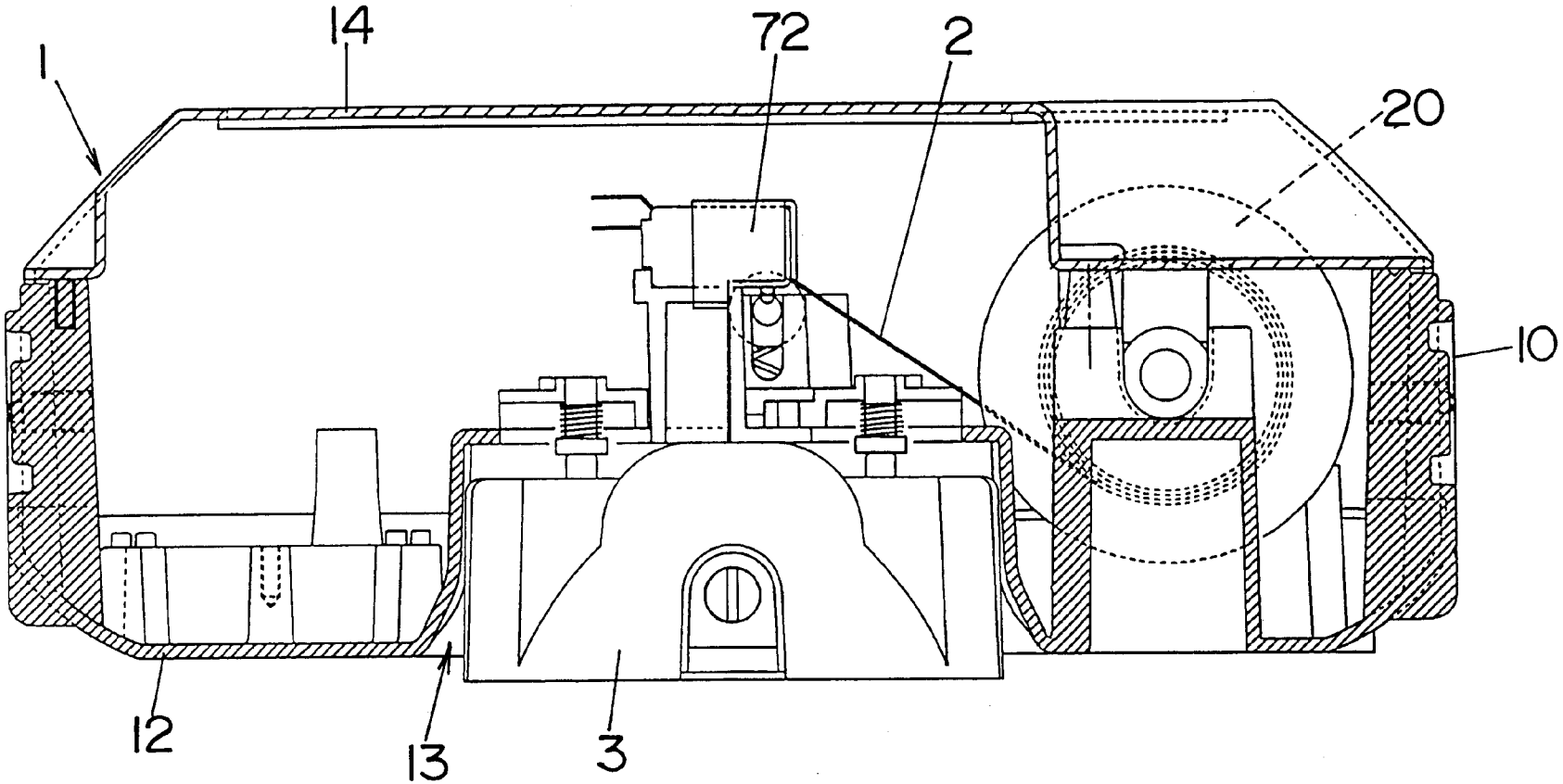
FIG. 3 is a schematic cross-sectional view illustrating the inner workings of the base.

Inner workings of the base 1 are shown in FIGS. 2 and 3. The base 1 has a case 10 with a concave 13 at its bottom surface. The load holder 3 can be fitted into the concave 13. This case 10 is formed with a chassis 12 produced by aluminum die-casting and secured to the ceiling, and a cover 14 made of a synthetic resin which is detachable to the chassis 12. The case 10 houses a drive unit for moving the load holder 3 up and down by use of the cables 2. Required electric circuits are placed at a region 7 on the chassis 12. The drive unit comprises a pair of winding drums 20 on which the cables are wound, DC motor 22 with a permanent magnet and a rectifier brush to rotate the winding drums, and a first reduction-gearing unit 26 for transmitting a power output of the DC motor to the winding drums, as shown in FIG. 2. In place of the DC motor, an AC motor may be used.

Figure 4:
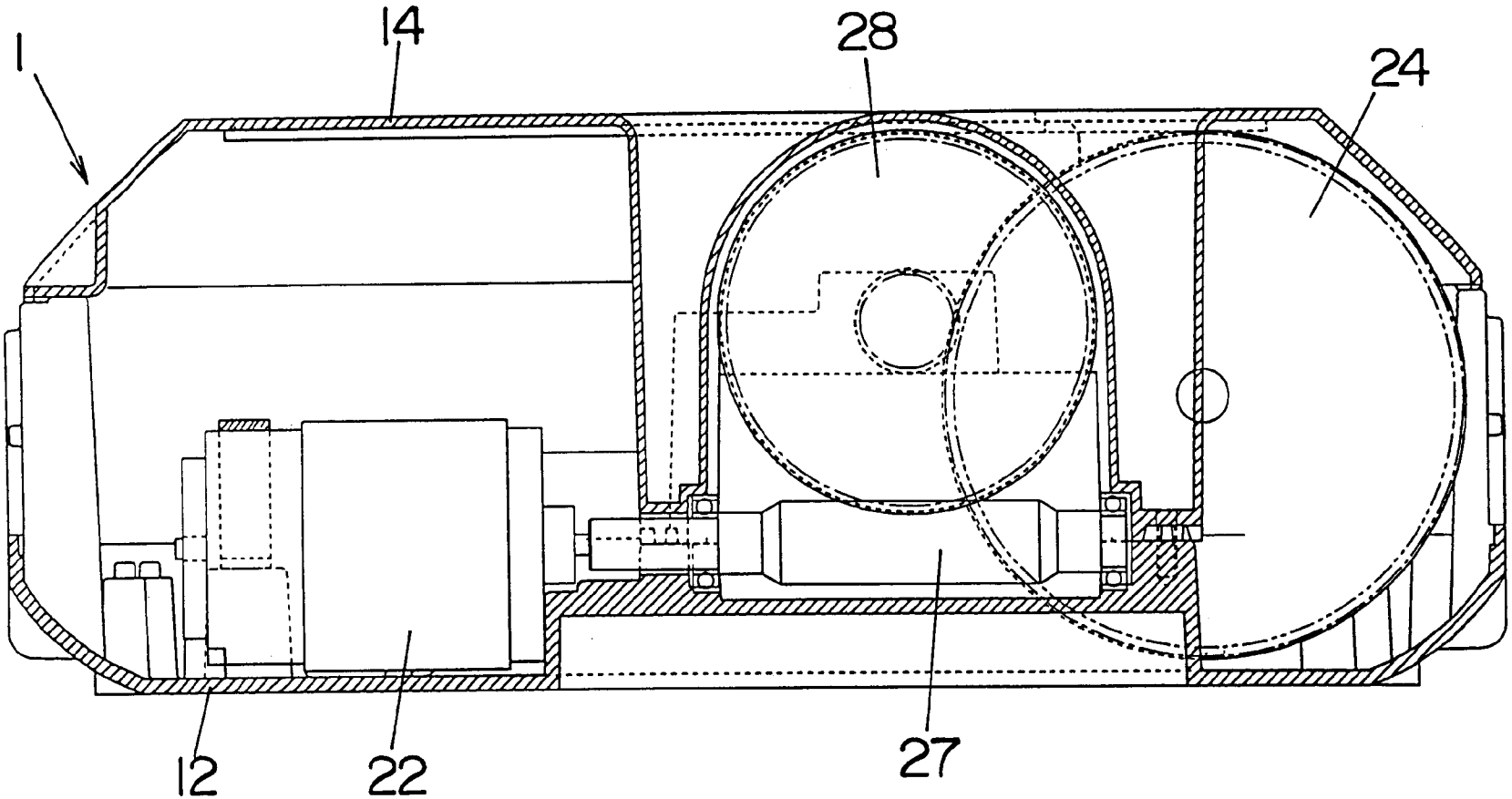
FIG. 4 is another schematic cross-sectional view illustrating the inner workings of the base.

The first reduction-gearing unit 26 has a self-lock mechanism for preventing a situation in which a rotation of the winding drums is transmitted in reverse to the DC motor when the DC motor is in rest condition. As shown in FIG. 4, the first reduction-gearing unit 26 comprises a worm gear 27 connected to a drive shaft of the DC motor 22, and a worm wheel 28 engaged with the worm gear. The rotation of the worm wheel 28 is transmitted to a spur wheel 24 attached to one end of a main shaft 21 that is a common axis of rotation of the winding drums 20, so that the winding drums 20 can be simultaneously rotated in the same direction.

Figure 5:
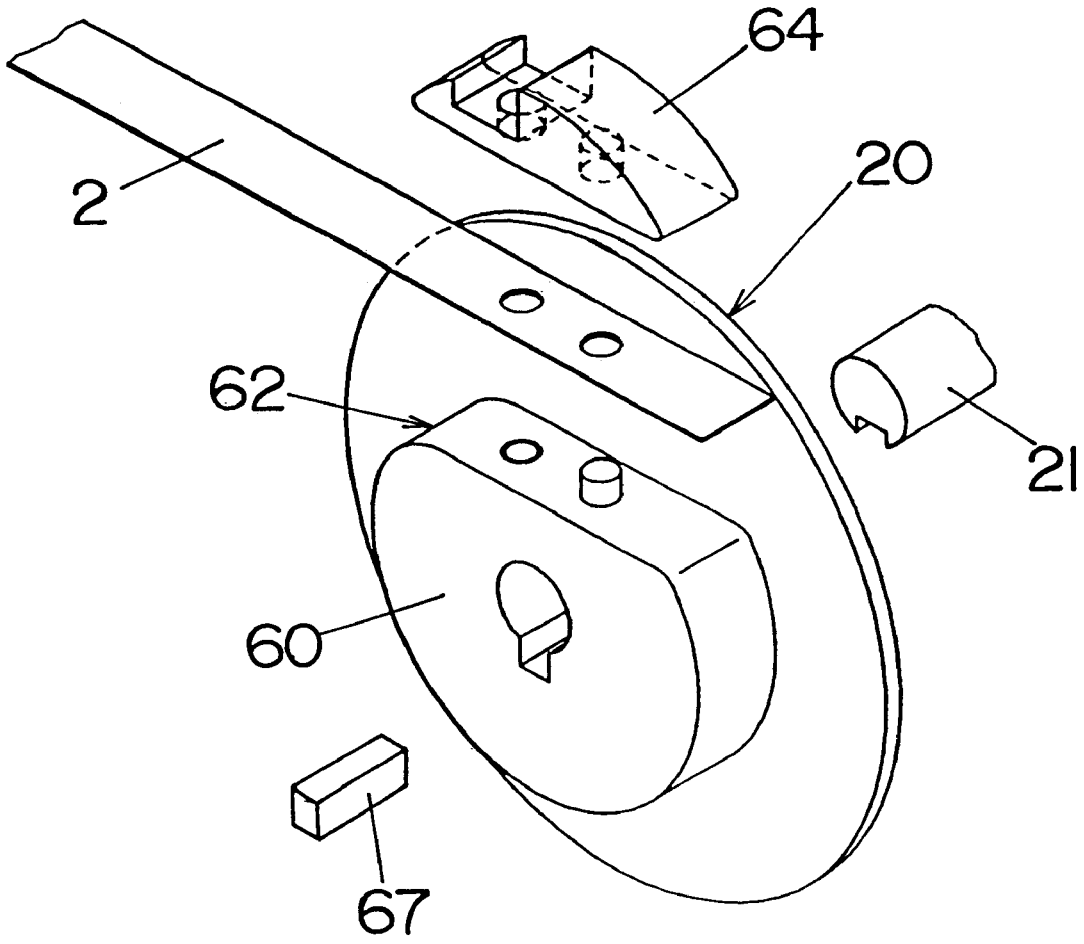
FIG. 5 is an exploded perspective view of a winding drum of the hoisting apparatus.

As shown in FIG. 5, each of the winding drums 20 is composed of a main body 60 having a rounded portion 62 that enhances winding of the cable 2 only when the winding drum rotates in one direction, and a cable catching member 64. One end of the cable 2 is tightly caught by friction between the main body 60 and the cable catching member 64. When the winding drum 20 is rotated in the direction to wind the cable 2 thereon, the rounded portion 62 protects the cable from local mechanical stress. In FIG. 5, the numeral 67 designates a pin for coupling the winding drum 20 to the main shaft 21.

The cable 2 connected to the winding drum 20 at its one end runs toward the load holder 3 through a sheave 5. In addition, the strip cables 2 mutually extend in a substantially same plane such that one of the cables is in parallel with the other cable.

By starting the DC motor 22, the load holder 3 can be moved up and down between a top position where the load holder is fitted into the concave 13 of the case 10, and a bottom position where the cables 2 are unwound from the winding drums 20 and the load holder 3 is spaced from the base 1.

The hoisting apparatus according to this embodiment of the present invention comprises a first cable-length adjust unit housed in a holder case 30 of the load holder 3, and a second cable-length adjust unit housed in the case of the base 1.

The second cable-length adjust unit is mainly used at the time of initial setup of the hoisting apparatus. That is, an amount of the cable 2 to be unwound from the winding drum 20 is determined according to the height of the ceiling by the second cable-length adjust unit, so that the load holder 3 can be stopped at a desired descending position. In this case, it is needed for a worker to climb to the ceiling and operate the second cable-length adjust unit. Thus, the second cable-length adjust unit is useful to carry out a coarse adjustment of the cable length at the time of initial setup of the hoisting apparatus.

On the other hand, the first cable-length adjust unit is preferably used when it is desired to delicately adjust the cable length determined by the second cable-length adjust unit or change the initially-set or previously-set descending position of the load holder 3 according to layout changes and so on. That is, since the first cable-length adjust unit is housed in the load holder 3, the worker can safely and readily operate the first cable-length adjust unit at the descending position of the load holder without operating the second cable-length adjust unit at the ceiling. Thus, the first cable-length adjust unit is useful to safely carry out a fine adjustment of the cable length after the initial setup of the hoisting apparatus.

Figure 10:
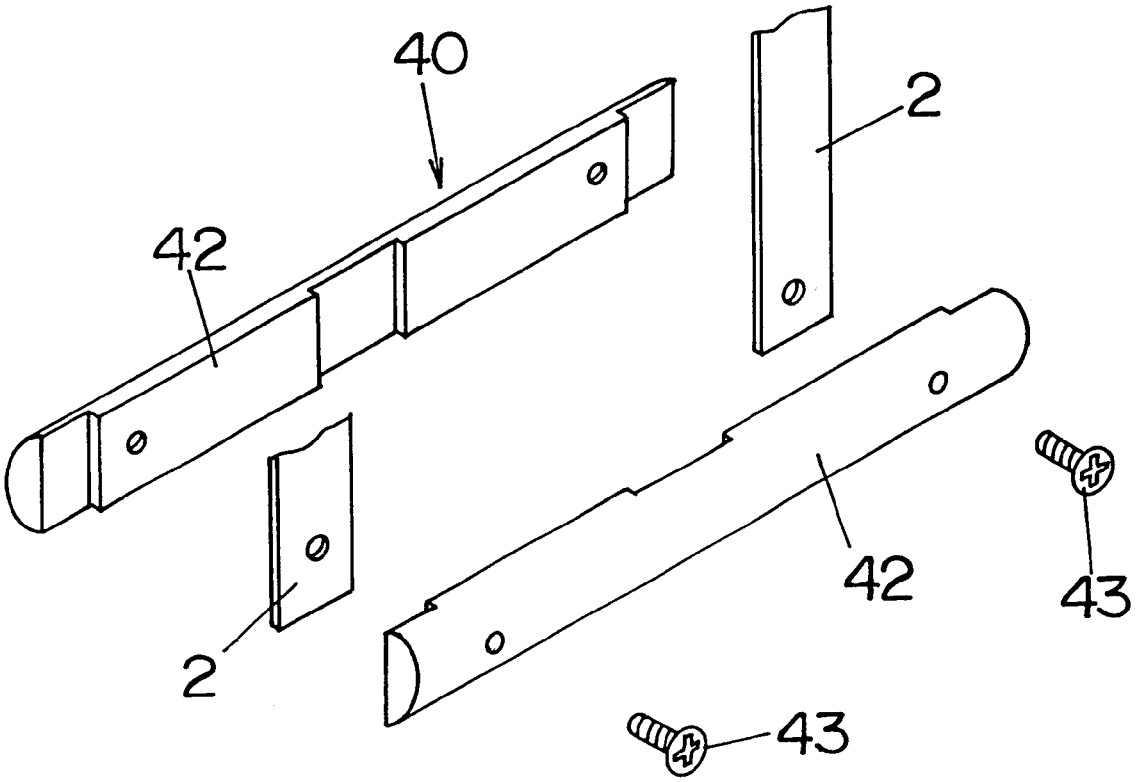
FIG. 10 is an exploded perspective view of a winding shaft of the hoisting apparatus.

The first cable-length adjust unit of this embodiment is explained below. As shown in FIGS. 6 to 9, the load holder 3 has the holder case 30 of a disk-like shape, in which a winding shaft 40 of a round-bar shape is rotatably supported. Each of the cables 2 is connected at its one end to the winding drum 20 and at the opposite end to the winding shaft 40. Therefore, when the winding shaft 40 is rotated, the cables 2 can be wound on the winding shaft. As shown in FIG. 10, the winding shaft 40 can be divided into a pair of elongate pieces 42 having the same shape. After the ends of the cables 2 are put between the elongate pieces 42, the elongate pieces are secured by use of screws 43 to tightly catch the cables by friction therebetween. This winding shaft 40 provides an advantage that the cables 2 are wound on the winding shaft 40 regardless of the rotating direction of the winding shaft.

Figure 7:
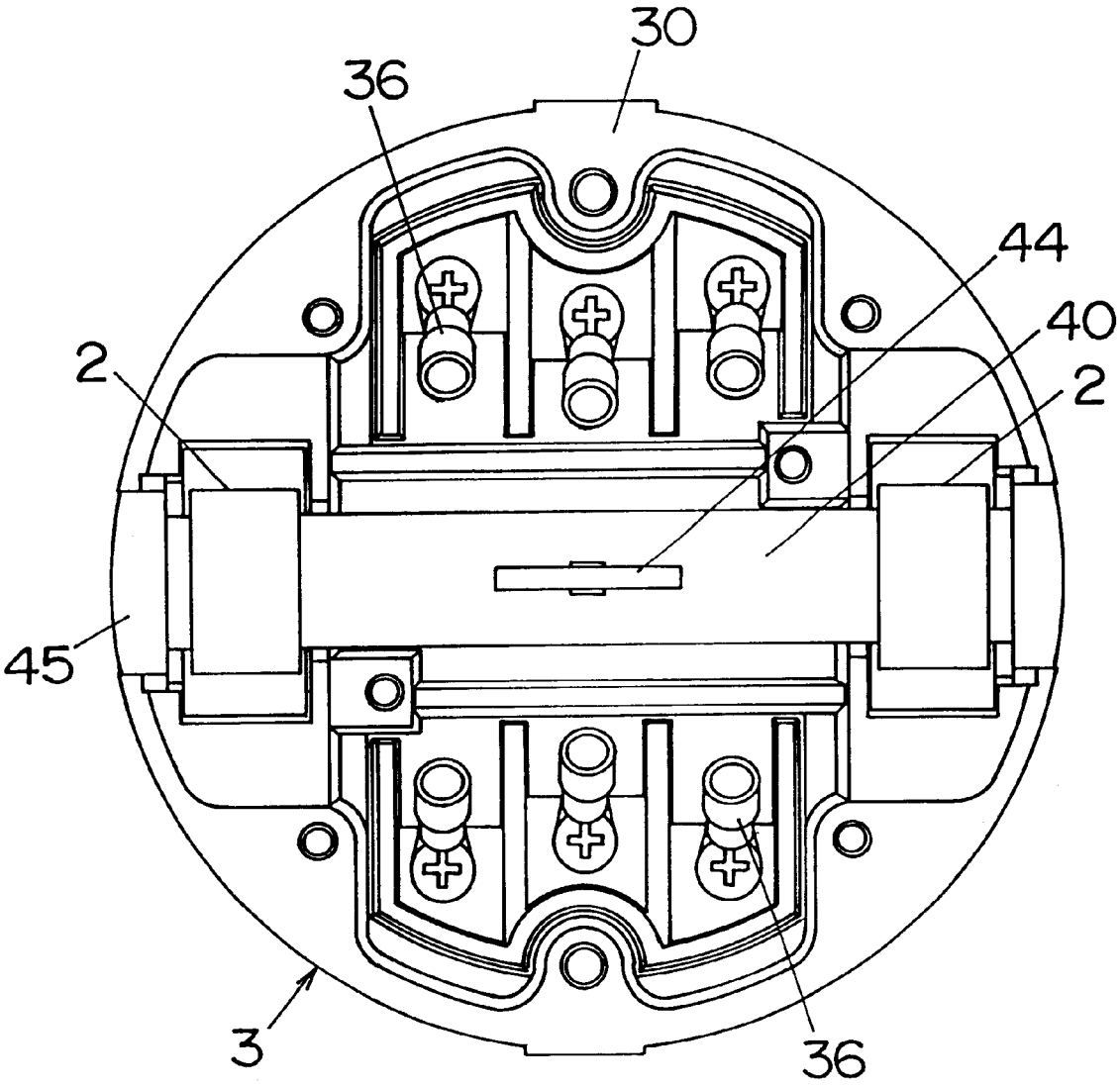
FIG. 7 is a bottom plan view of the load holder.
Figure 8A:
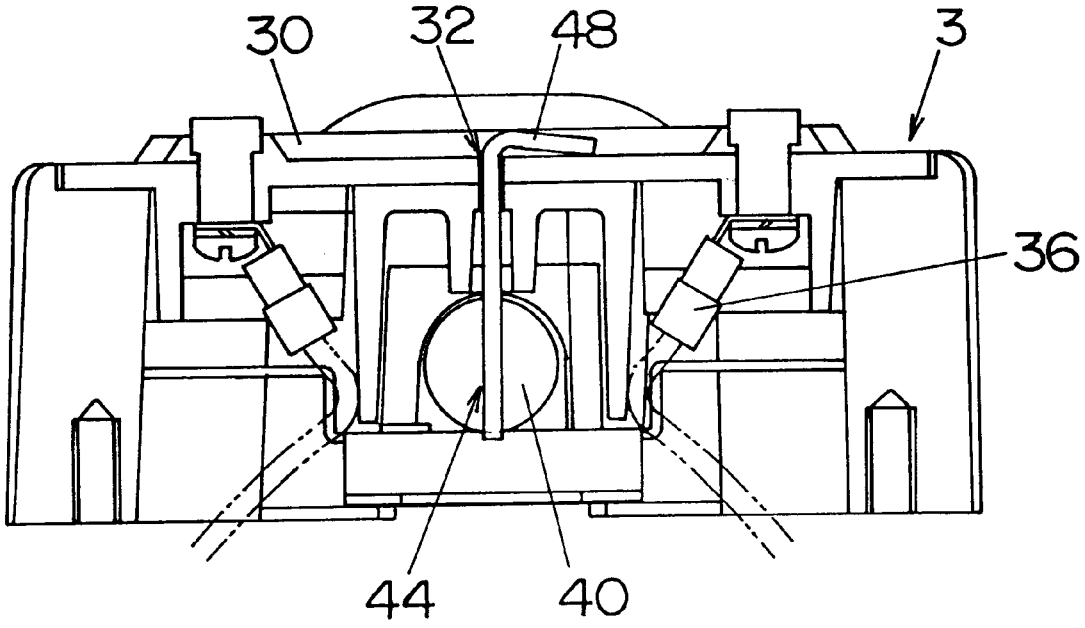
FIGS. 8A and 8B are cross-sectional and side views of the load holder, respectively.

As shown in FIG. 7, the winding shaft 40 has an elongate through-hole 44 formed in a direction perpendicular to its axial direction. As shown in FIG. 8A, a rotation-inhibiting member 48 can be inserted in the elongate through-hole 44 of the winding shaft through a slit 32 formed in the upper surface of the holder case 30 to inhibit the rotation of the winding shaft. The winding shaft 40 also has engagement grooves 45 at its opposite ends, to which the rotation-inhibiting member 48 can be engaged. The grooves 45 of the winding shaft 40 are exposed to be accessible from outside of the holder case 30, as shown in FIG. 8B.

Figure 12:
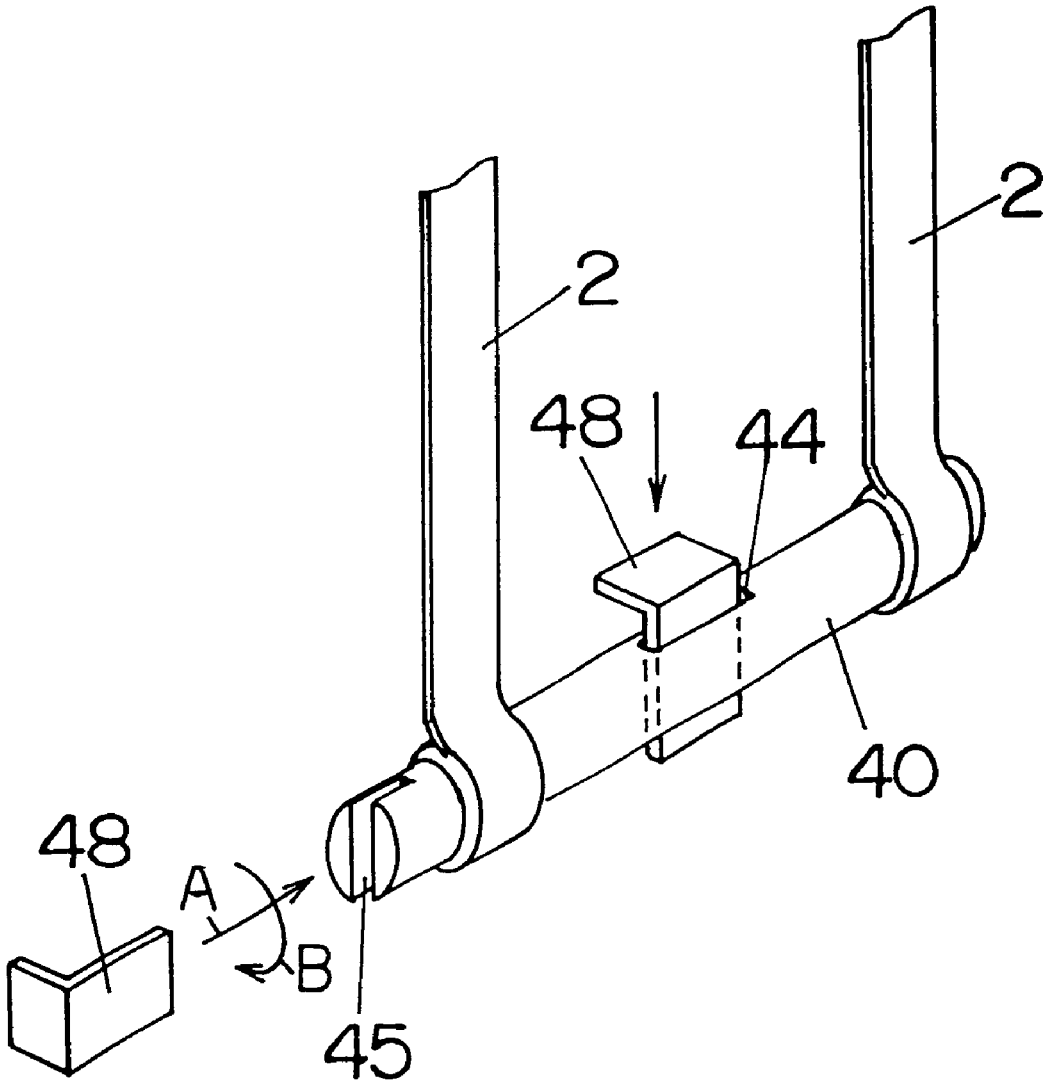
FIG. 12 is a schematic view explaining an operation of a cable-length adjust unit of the load holder.

By use of the first cable-length adjust unit with the above-explained structure, the length of the cables 2 can be adjusted as follows. That is, the rotation-inhibiting member 48 is engaged to one of the grooves 45 of the winding shaft 40, as shown by the arrow A in FIG. 12, and then rotated to wind desired amounts of the cables on the winding shaft, as shown by the arrow B in FIG. 12. Since proper tension is applied to the cables 2 under the suspended condition of the load holder 3, it is possible to readily wind the cables 2 on the winding shaft 40 without looseness. After the desired mounts of the cables 2 are wound on the winding shaft 40, the rotation-inhibiting member 48 is removed from the groove 45, and inserted into the longate through-hole 44 of the winding shaft, to thereby inhibit the rotation of the winding shaft and prevent unwinding of the cables 2 from the winding shaft.

In place of the rotation-inhibiting member 48, an electric flatblade screwdriver may be engaged to the groove 45 to rotate the winding shaft. In place of the groove 45, an adjustment knob may be formed on at least one end of the winding shaft 40. In this case, it is possible to wind the cables 2 on the winding shaft without using special tools.

Figure 6:
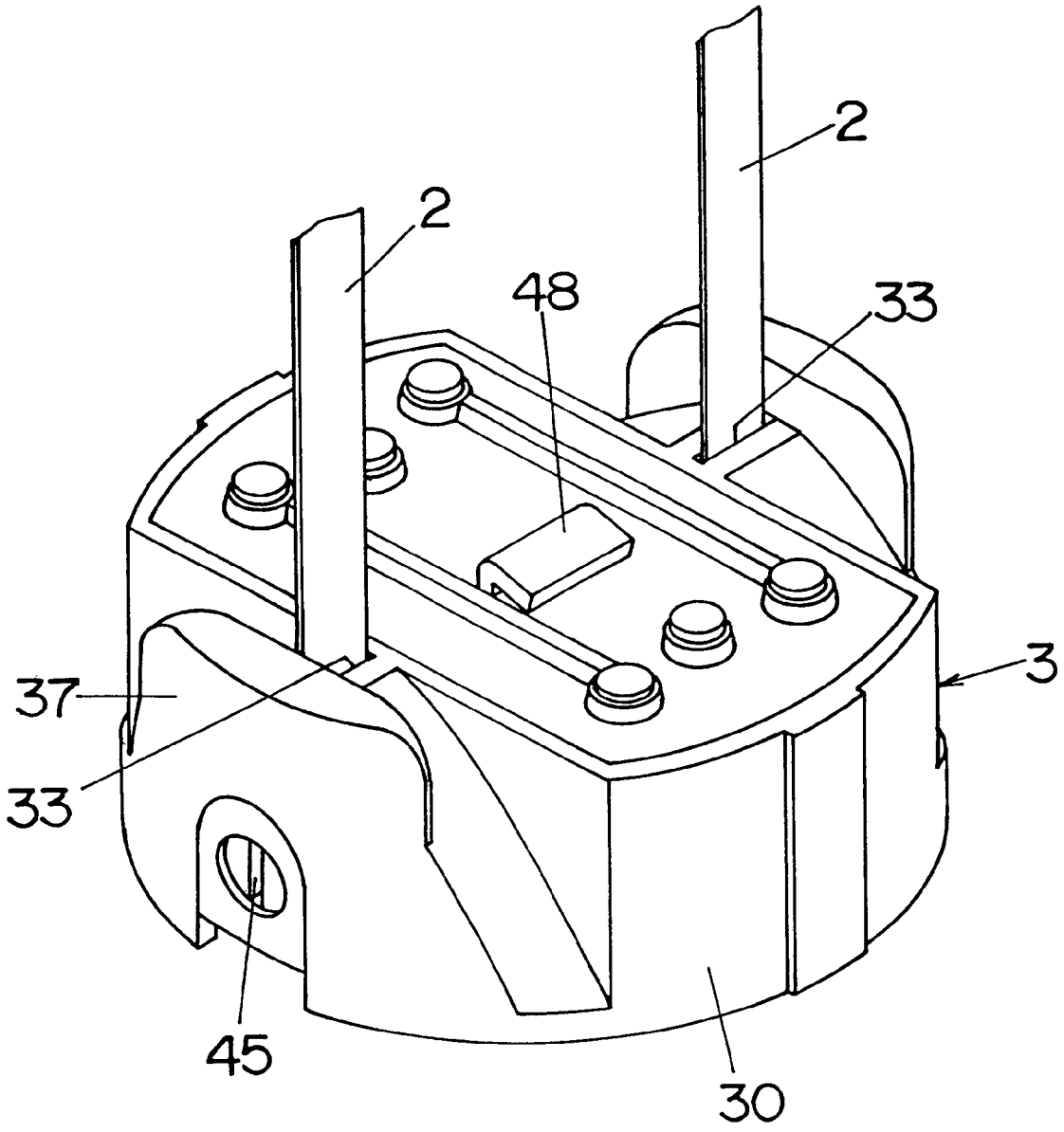
FIG. 6 is a perspective view of a load holder of the hoisting apparatus.
Figure 8B:
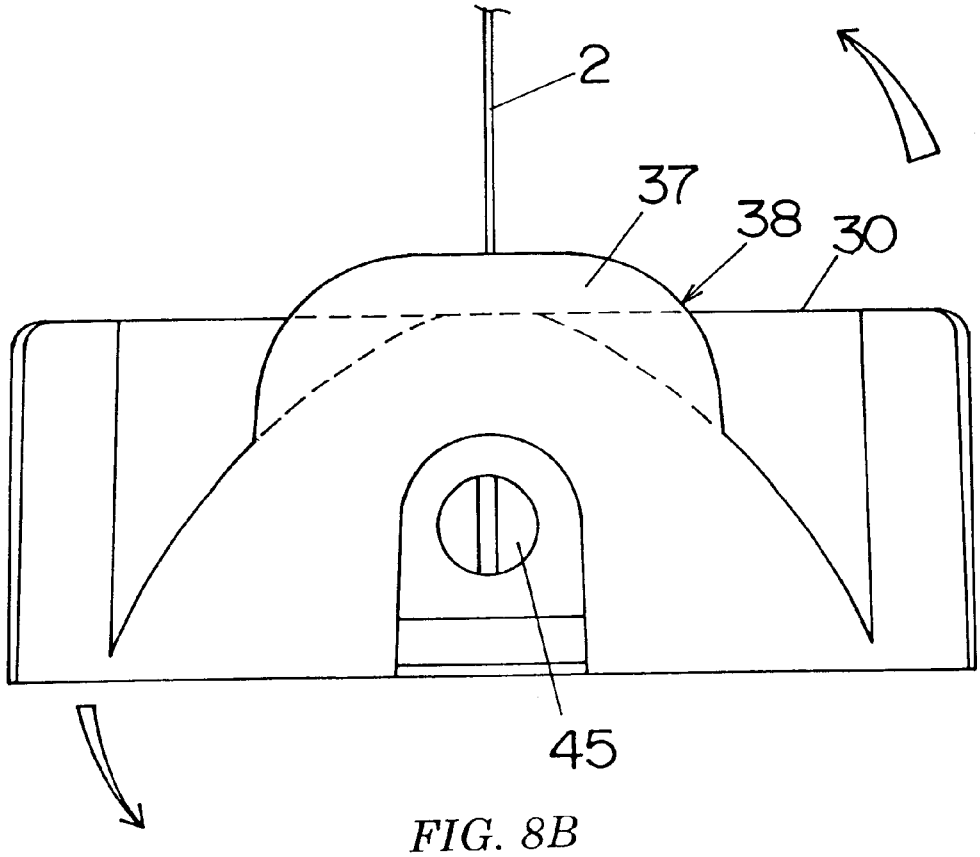
Figure 9:
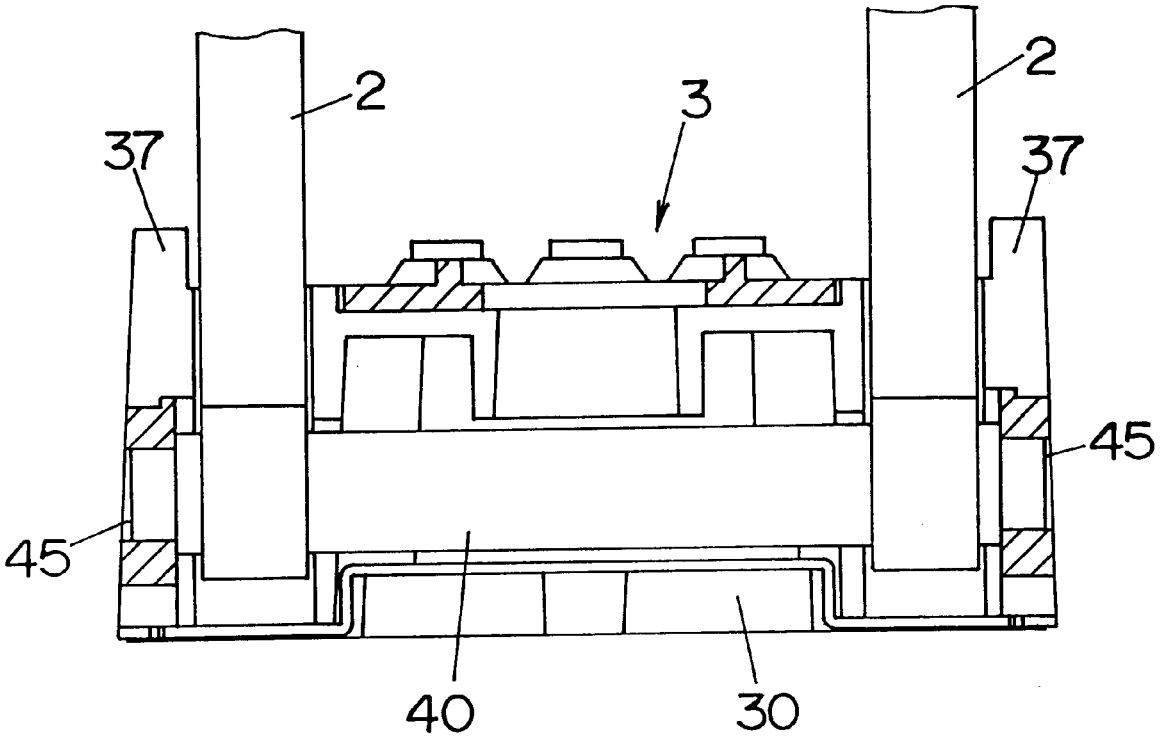
FIG. 9 is another cross-sectional view of the load holder.

In addition, the holder case 30 has a pair of protrusions 37 extending upward from the rim of the holder case to prevent a situation in which the load holder 3 suspended from the base 1 is rotated about the axis of the winding shaft by mistake, as shown by the arrows in FIG. 8B, to form a kink in the cables. Each of the protrusions 37 is formed at a position adjacent to the cable 2 under the suspended condition of the load holder 3, as shown in FIG. 6. The protrusion 37 also has an arcuate top end that is effective as guide means for smoothly introducing the load holder 3 into the concave 13 of the case 10. Edges 38 of the protrusions 37 are rounded to protect the cable 2 from damage even when the cable makes contact with the protrusion by mistake.

Figure 11:
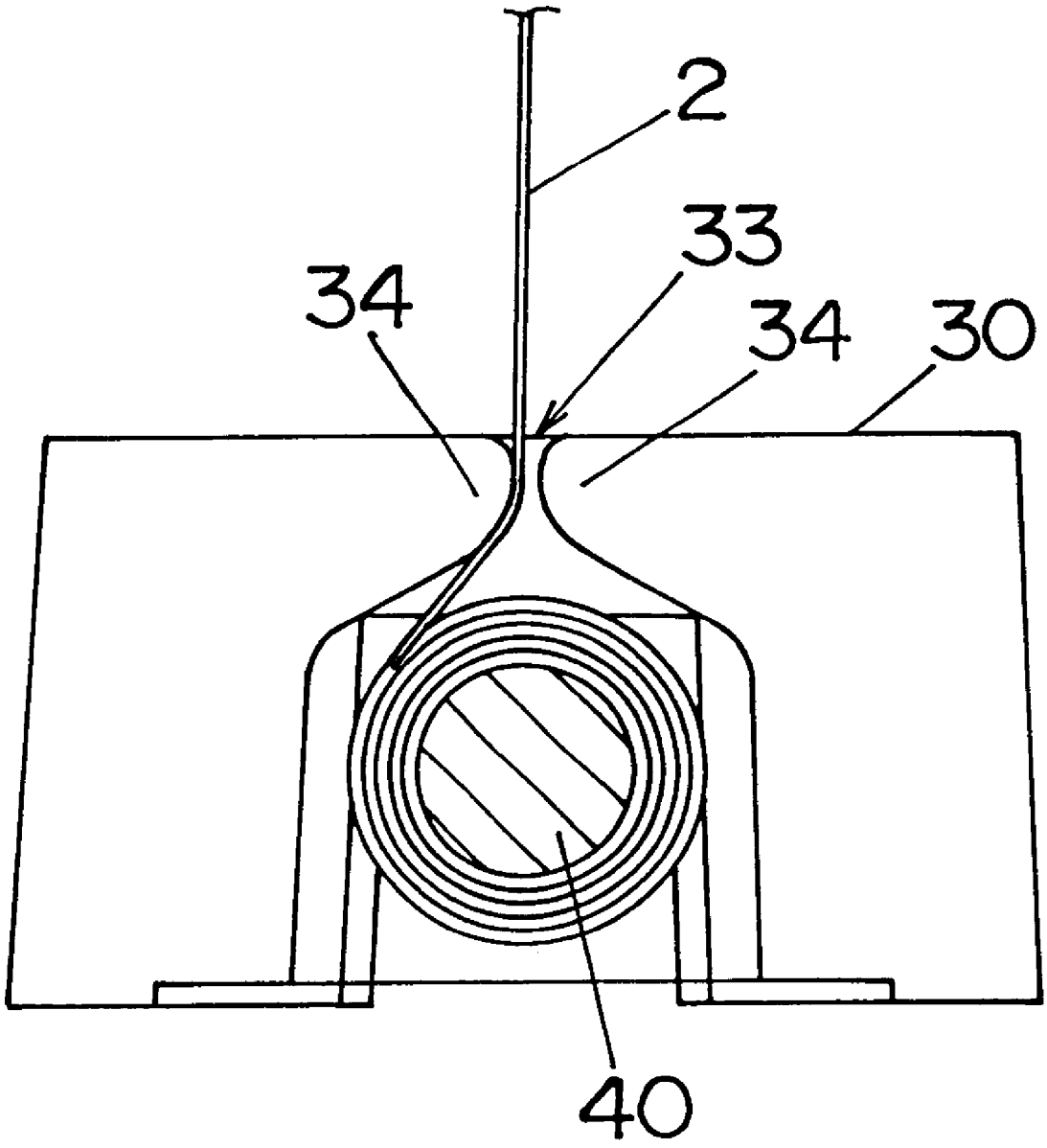
FIG. 11 is a schematic view illustrating cable-guide projections of the load holder.

Moreover, as shown in FIG. 11, the holder case 30 of the load holder 3 has two pairs of cable guide projections 34, each pair of which is disposed above the end portion of winding shaft 40. Each of the cables 2 extends from the first cable-length adjust unit housed in the holder case 30 toward the base 1 through a clearance 33 between the guide projections 34. By the way, as described above, the tension is applied to the cables 2 under the suspended condition of the load holder 3. Therefore, even if the cable 2 make contact with a part of the holder case 30 in a line-contact manner, it may locally receive large stress to accelerate the degradation of the cable. In this embodiment, each of the cables 2 provided from the winding shaft 40 makes contact with one of the guide projections 34, as shown in FIG. 11. However, since each of the guide projections 34 has a rounded tip, the cable 2 makes contact with the rounded tip in a plane-contact manner. As a result, it is possible to reduce the degradation of the cables 2 by the contact with the holder case 30.

In FIG. 7, the numeral 36 designates a connector adapted to electrically connect a luminaire (not shown) with the load holder 3. The attachment of the luminaire to the load holder 3 can be performed by use of conventional fixtures selected according to the type of the luminaire. Therefore, detailed explanation for the fixtures is omitted.

Figure 13:
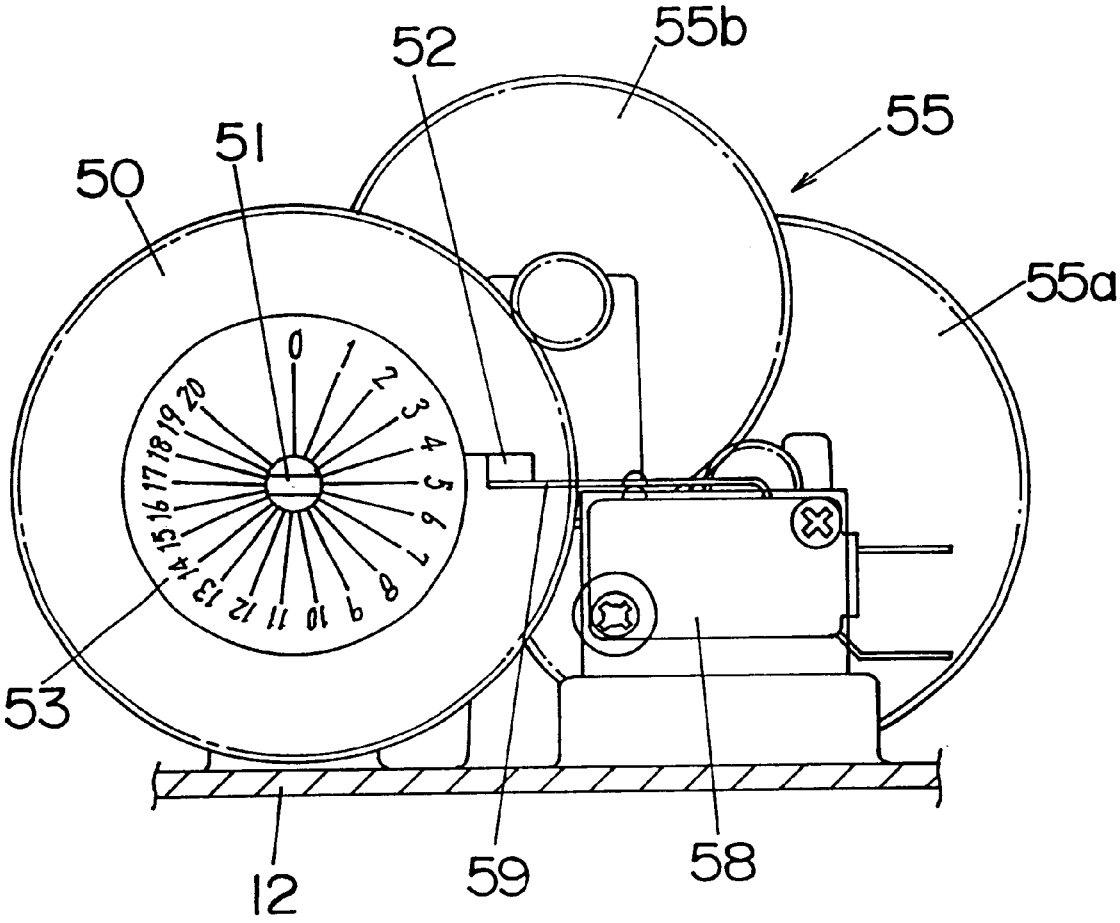
FIG. 13 is a schematic view showing a cable-length adjust unit of the base of the hoisting apparatus.

Next, the second cable-length adjust unit of this embodiment is explained. As shown in FIG. 13, the second cable-length adjust unit comprises a final gear 50, which is rotated at a rotation amount of less than one turn according to the rotation of the winding drum 20 when the load holder 3 is moved from the top position to the bottom position, second reduction-gearing unit 55 for transmitting the rotation of the winding drums to the final gear, and a stop switch 58 for automatically stopping a supply of electric power to the DC motor 22 when the rotating body reaches the rotation amount, to thereby stop the downward movement of the load holder.

Figure 14:
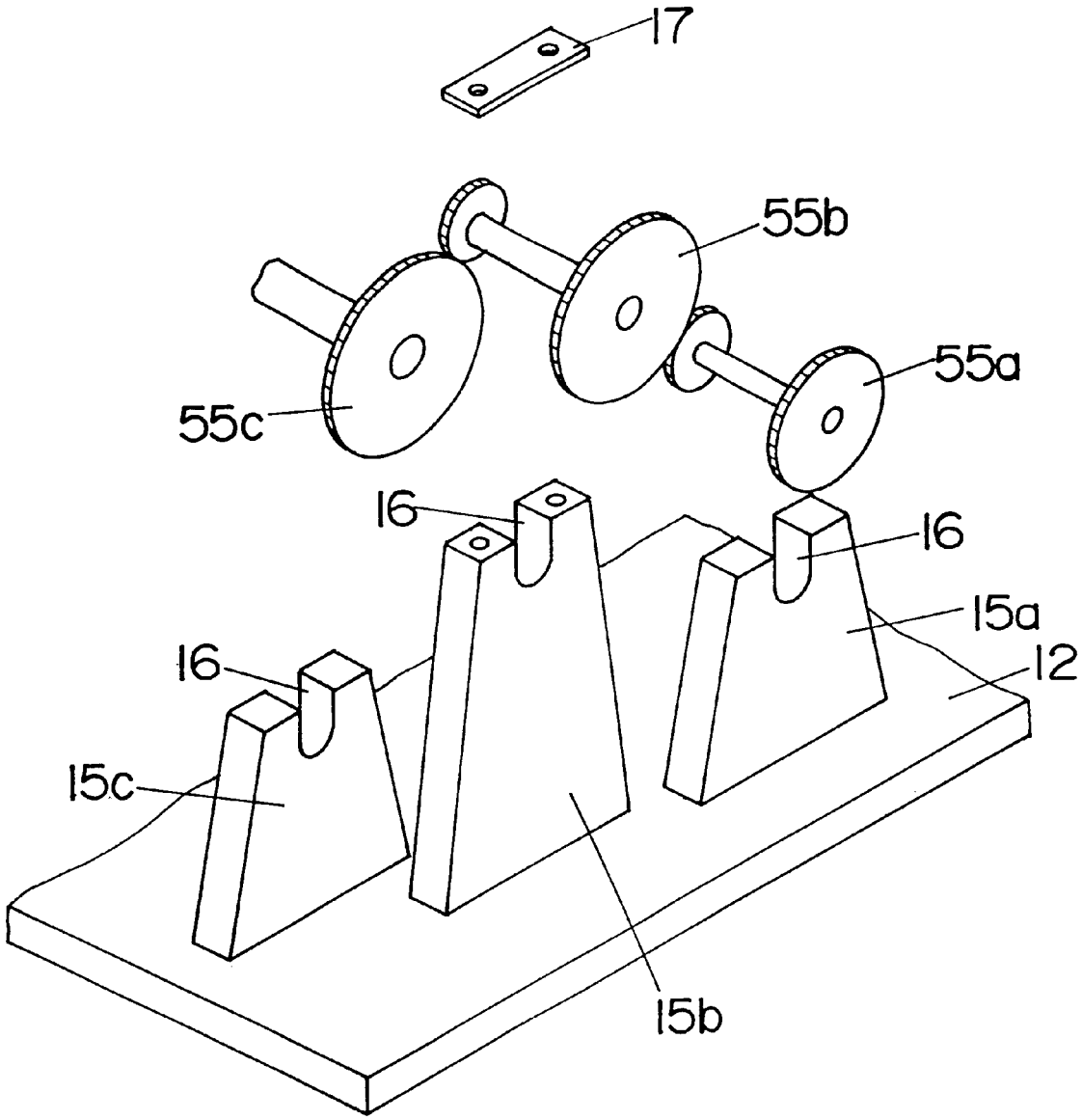
FIG. 14 is an exploded perspective view illustrating a bearing mechanism for the cable-length adjust unit of the base.

The second reduction-gearing unit 55 comprises a plurality of gears 55*a* to 55*c* engaged mutually. These gears are supported by a bearing unit integrally molded with the chassis 12. As shown in FIG. 14, the bearing unit is provided with a plurality of projections 15*a* to 15*c* of different heights, each of which has at its top end a bearing concave 16 for receiving a rotation shaft of the gear. In this embodiment, when one of the gears 55*b* is rotatably supported in the bearing concave 16 of the projection 15*b* having the greatest height by use of a supporting member 17, the remaining gears 55*a*, 55*c* engaged with the gear 55*b* can be supported in the bearing concaves 15*a*, 15*c* without using additional supporting member. The supporting member 17 may be integrally molded with the cover 14. In this case, the rotation shaft of the gear 55*b* can be held between the bearing concave 16 and the integrally-molded supporting member by attaching the cover 14 to the chassis 12.

If necessary, the concept of the bearing unit described above can be applied to the first reduction-gearing unit for transmitting the power output of the DC motor 22 to the winding drums 20. When using the bearing unit integrally molded with the chassis 12, the component count is reduced, so that the structure of the base I can be further simplified. In addition, it is effective to improve the cost performance of the hoisting apparatus.

The second reduction-gearing unit 55 is engaged at it one end to a spur wheel 25 attached to the opposite end of the main shaft 21 and at the other end to the final gear 50. As shown in FIG. 13, the final gear 50 has an adjustment knob 51 used to disengage the final gear from the second reduction-gearing unit 55 and change the rotation amount of the final gear. In addition, the final gear 50 is formed on its front surface with a claw 52 for pushing a lever 59 of the stop switch 58 and a scale 53 used to set the rotation amount.

The adjustment knob 51 is exposed to be accessible from outside of the cover 14, as shown in FIG. 1. The scale 53 can be checked through a window 18 formed in the cover 14. The final gear 50 receives a spring bias from a spring 54 in its axial direction. Therefore, the final gear 50 is moved in the axial direction against the spring bias to disengage the final gear from the second reduction-gearing unit 55, and then the rotation amount of the final gear can be set.

By use of the second cable-length adjust unit with the above-explained structure, the length of the cables 2 can be adjusted as follows. That is, the rotation amount of the final gear 50 is initially set referring to the scale 53. Then, the DC motor 22 is started to lift down the load holder 3 from the concave 13 of the case 10. At this time, the rotation of the winding drums 20 is transmitted to the final gear 50 through the second reduction-gearing unit 55, so that the final gear rotates at a slower speed. As shown in FIG. 13, when the final gear 50 reaches the set rotation amount, the claw 52 pushes the lever 59 of the stop switch 58 downward to stop the supply of electric power to the DC motor 22. As a result, the load holder 3 is stopped at a required descending position.

Thus, when using the second cable-length adjust unit, the descending position of the load holder 3 is determined by adjusting the amounts of cables 2 unwound from the winding drum 20. On the other hand, when using the first cable-length adjust unit, the descending position of the load holder 3 is determined by adjusting the amounts of cables 2 wound on the winding shaft 40.

In addition, the hoisting apparatus according to the present embodiment comprises first and second brake units for automatically stopping the up-and-down movements of the load holder 3.

Figure 15:
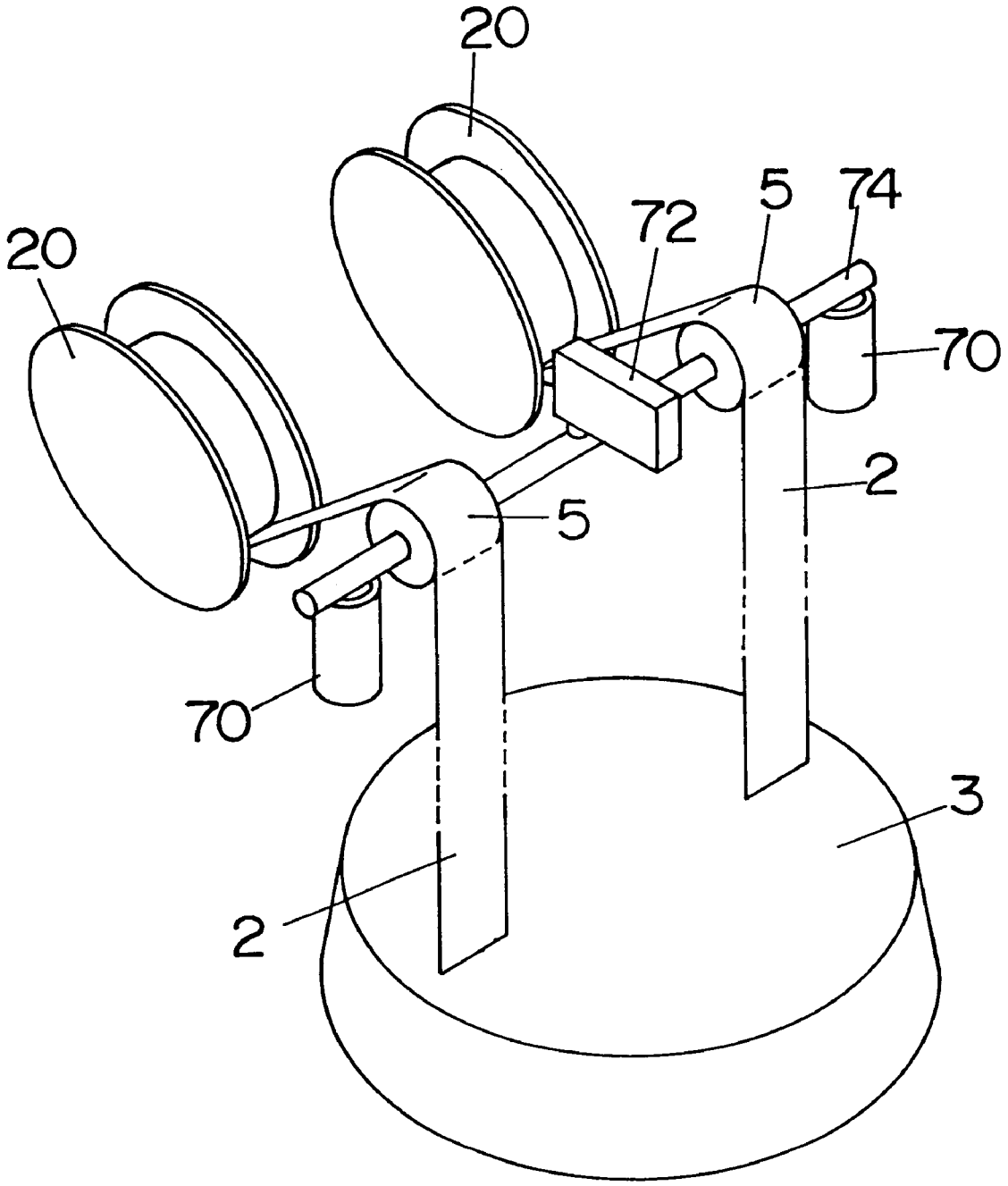
FIG. 15 is a schematic perspective view of a first automatic brake unit of the hoisting apparatus.

The first brake unit automatically stops the supply of electric power to the DC motor 22 when winding the cables 2 on the winding drums 20 is finished. As shown in FIG. 15, the first brake unit is provided with a pair of sheaves 5 for turning the cables 2 provided from the winding drum 20 toward the load holder 3, a coupling rod 74 which works as a common axis of rotation of the sheaves 5, elastic body 70 such as coil springs for movably supporting the coupling rod 74, and a first switch 72 for stopping the supply of electric power to the DC motor 22 when a positional displacement of the coupling rod 74 is caused by elastic deformation of the elastic body 70 according to an increase in tension of the cables.

Figure 16B:
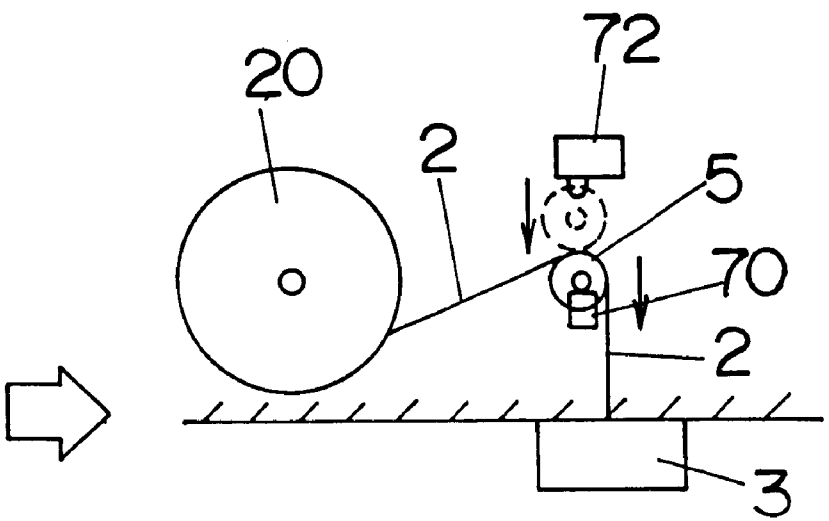
FIGS. 16A and 16B are schematic views explaining operations of the first automatic brake unit.
Figure 16A:
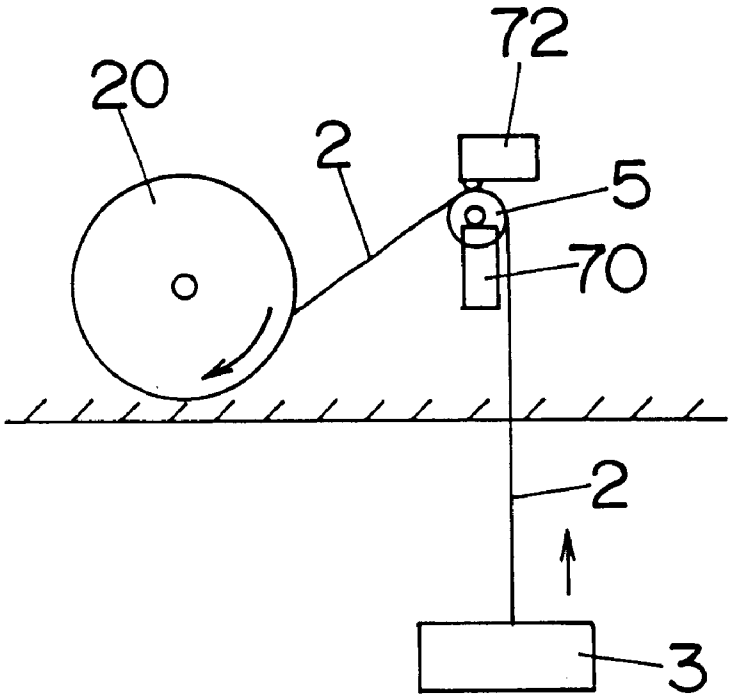

That is, as shown in FIG. 16A, since the coupling rod 74 makes contact with the first switch 72 until the load holder 3 moves upward toward the base 1, the supply of electric power to the DC motor 22 is continued. When the load holder 3 reaches the concave 13 of the case 10, the upward movement of the load holder 3 is stopped. However, at this time, as the winding drums 20 are further rotated, the tension of the cables 2 increases, so that the elastic body 70 is elastically deformed and both of the sheaves 5 and the coupling rod 74 slightly move downward, as shown by the arrows in FIG. 16B. When the coupling rod 74 leaves from the first switch 72, the supply of electric power to the DC motor is stopped. The first brake unit works under an abnormal condition that the upward movement of the load holder 3 is interfered with obstacles, as well as the normal condition that winding of the cables 2 is finished.

Figure 17:
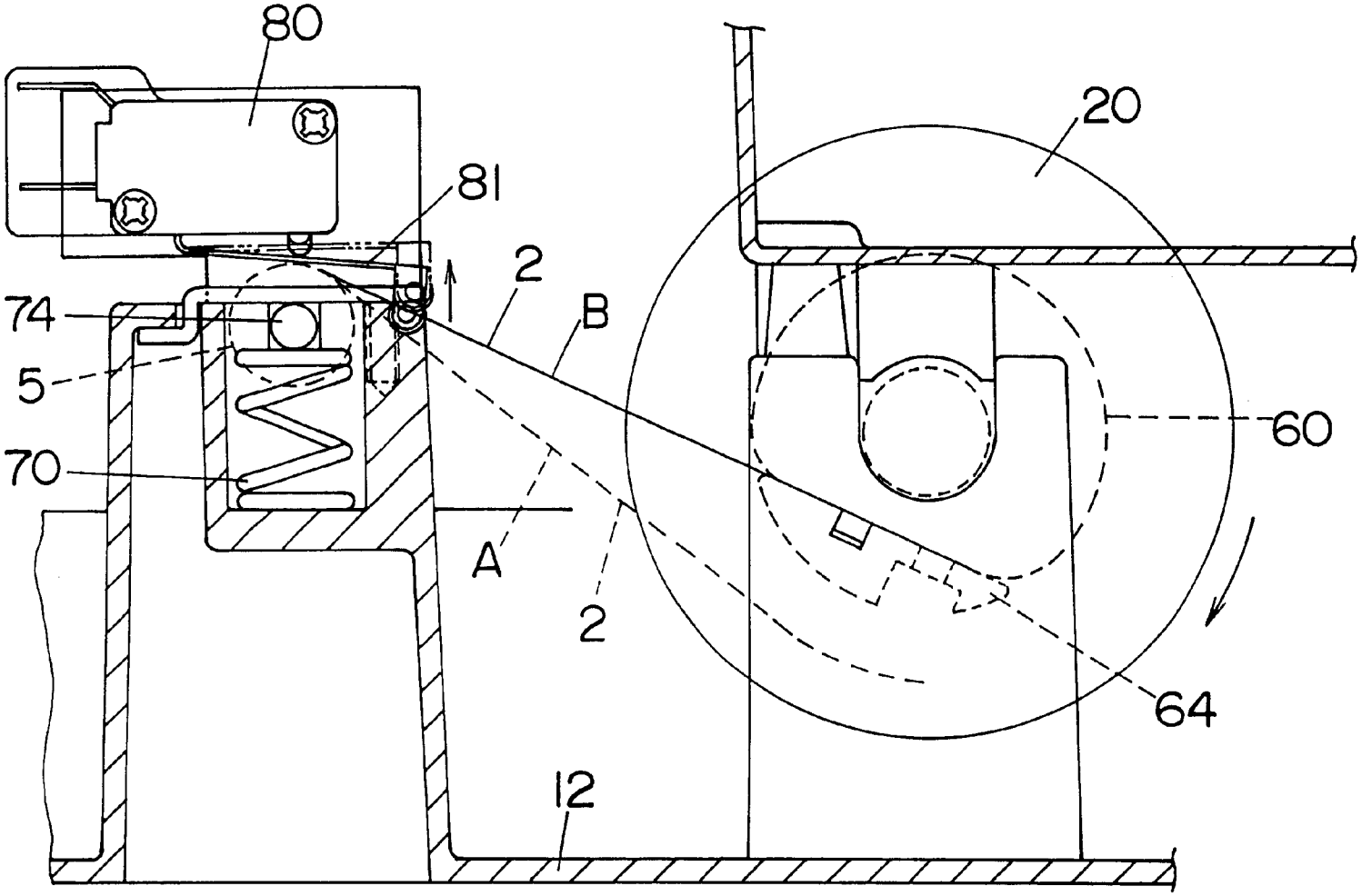
FIG. 17 is a partially cross-sectional view explaining an operation of a second automatic brake unit of the hoisting apparatus.

On the other hand, the second brake unit automatically stops the supply of electric power to the DC motor 22 when unwinding the cables 2 from the winding drums 20 is finished, or the tension of the cables 2 considerably decreases. As shown in FIG. 17, when a position (dotted line A) of the cable 2 extending between the sheave 5 and the winding drum 20 during the downward movement of the load holder 3 is in agreement with the position (solid line B) of the cable 2 extending therebetween when all of the cable 2 are unwound from the winding drum 20, the cable itself pushes a lever 81 of a second switch 80 upward to stop the supply of electric power to the DC motor 22. As a result, it is possible to prevent a situation in which the rotation of the winding drums 20 is continued after unwinding of the cables 2 is finished, so that the cables 2 are wound in reverse on the winding drums 20.

If necessary, it is possible to setup the second brake unit such that when the position of the cable 2 extending between the sheave 5 and the winding drum 20 during the downward movement of the load holder 3 is in agreement with the position of the cable 2 extending therebetween when a predetermined amount of the cable 2 is unwound from the winding drum 20, the second switch 80 is activated by the cable itself.

Figure 18:
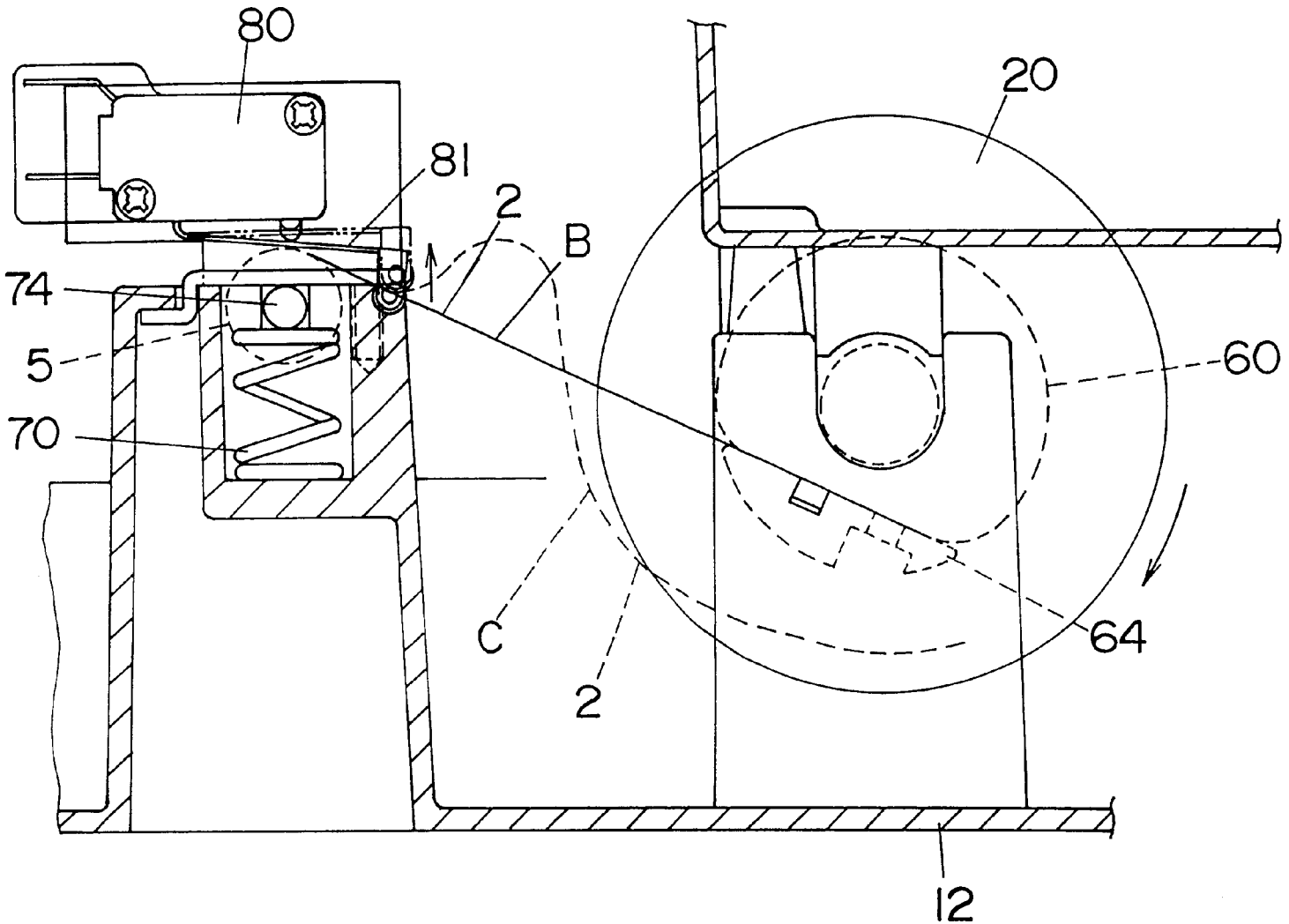
FIG. 18 is a partially cross-sectional view explaining another operation of the second automatic brake unit.

In addition, when the load holder 3 reaches a floor, or the downward movement of the load holder is interfered with obstacles, a slack of the cable 2 is caused by a decrease in tension of the cable. As a result, the second switch 80 can be activated by the cable itself under the slack condition. That is, as shown in FIG. 18, when the slack of the cable 2 (dotted line C) goes beyond the position (solid line B) of the cable 2 extending between the winding drum 20 and the sheave 5 when all of the cable is unwound from the winding drum, the lever 81 of the second switch 80 is pushed upward by the cable itself to stop the supply of electric power to the DC motor 22. Thus, the second brake unit works under the abnormal condition that the slack of the cable occurs during the downward movement of the load holder 3, as well as the normal condition that unwinding of the cables 2 is finished.

In addition, the hoisting apparatus of the present embodiment comprises a safety unit for preventing a free fall of the load holder 3 by its own weight. As described above, when winding of the cables 2 on the winding drums 20 is finished, and the load holder 3 is fitted into the concave 13 of the case 10, the supply of electric power to the DC motor 22 is stopped. At this time, since the DC motor 22 is not energized, the load holder 3 may move downward in a free-fall manner due to its own weight if no measure of any kind is instituted. Such a free fall of the load holder 3 can be prevented by the self-locking mechanism of the first reduction-gearing unit 26. However, as a double safety measure, this hoisting apparatus also has the safety unit for inhibiting the rotation of the drive shaft 87 of the DC motor 22 when the load holder 3 is fitted into the concave 13.

Figure 19A:
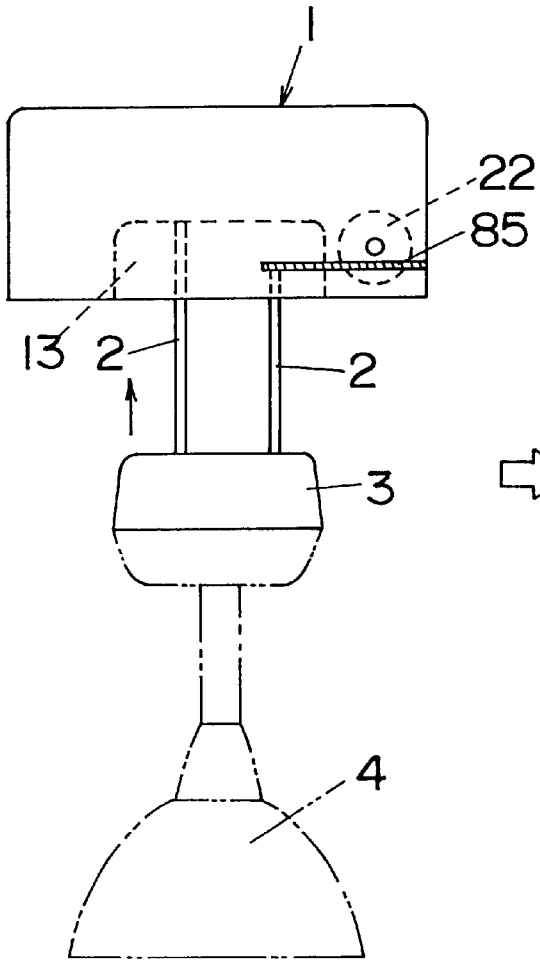
FIGS. 19A and 19B are schematic views explaining operations of a third automatic brake unit of the hoisting apparatus.
Figure 19B:
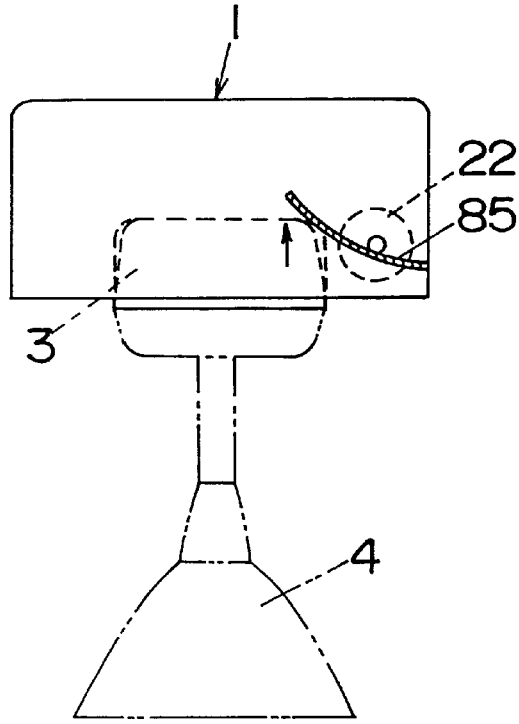
Figure 20:
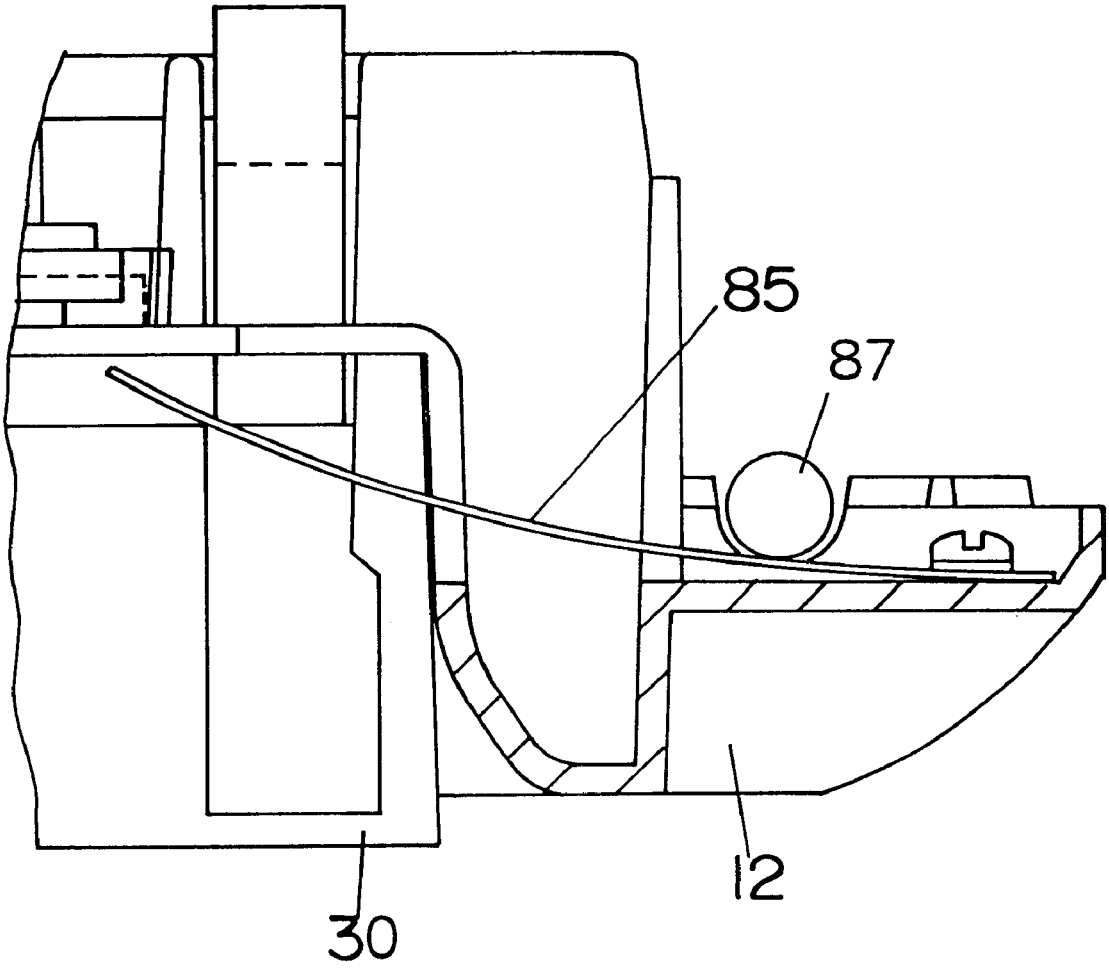
FIG. 20 is a partially cross-sectional view illustrating an operating state of the third automatic brake unit.

That is, as shown in FIGS. 19A and 20, this safety unit comprises a flat-spring member 85 disposed adjacent to the drive shaft 87 of the DC motor such that one end of the flat spring member projects into the concave 13 and the other end is fixed to the chassis 12 by a screw. As shown in FIG. 19B, when the load holder 3 is fitted into the concave 13, the projecting end of the flat-spring member 85 is pushed upward by an edge of the load holder, so that a part of the elastically-deformed spring member 85 is pressed against the drive shaft 87. Thus, the rotation of the drive shaft 87 of the DC motor 22 is inhibited with reliability by friction between the flat-spring member 85 and the drive shaft. This safety is relatively simple in construction and excellent in cost performance. If necessary, one of the self-locking mechanism of the first reduction-gearing unit 26 and the safety unit may be adopted.

In the above embodiment, the flat spring member 85 is directly pressed against the drive shaft 87 of the DC motor 20 to inhibit the rotation of the drive shaft. As a modification, the rotation of the drive shaft 87 may be indirectly inhibited by providing a friction force to a power transmission mechanism disposed between the DC motor 22 and the winding drum 20.

Figure 21:
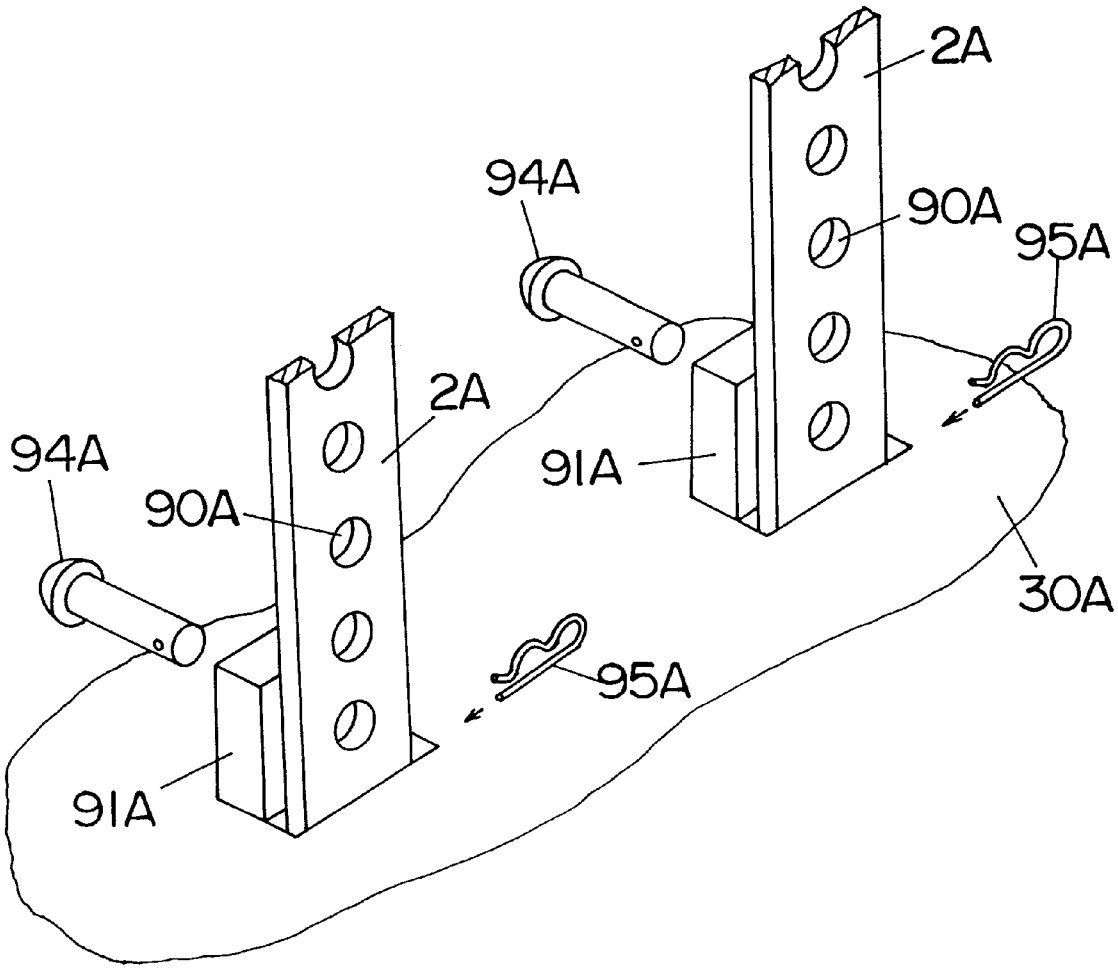
FIG. 21 is a partially perspective view showing a modification of the cable-length adjust unit of the load holder.

FIG. 21 shows a modification of the first cable-length adjust unit of the load holder 3. In this modification, plural holes 90A are formed in each of cables 2A by a required pitch. After desired amounts of the cables 2A are wounded on a winding shaft (not shown) rotatably supported in a holder case 30A of the load holder, the cables are fixed to cable-catching portion 91A projected on the upper surface of the holder case 30A by use of fixtures. As the fixtures, for example, it is preferred to use sets of a pin 94A and a snap 95A, as shown in FIG. 21. In this case, there is an advantage that each of the cables 2A can be readily fixed to the cable-catching portion 91A. Alternatively, conventional bolts and nuts may be used.

Figure 22:
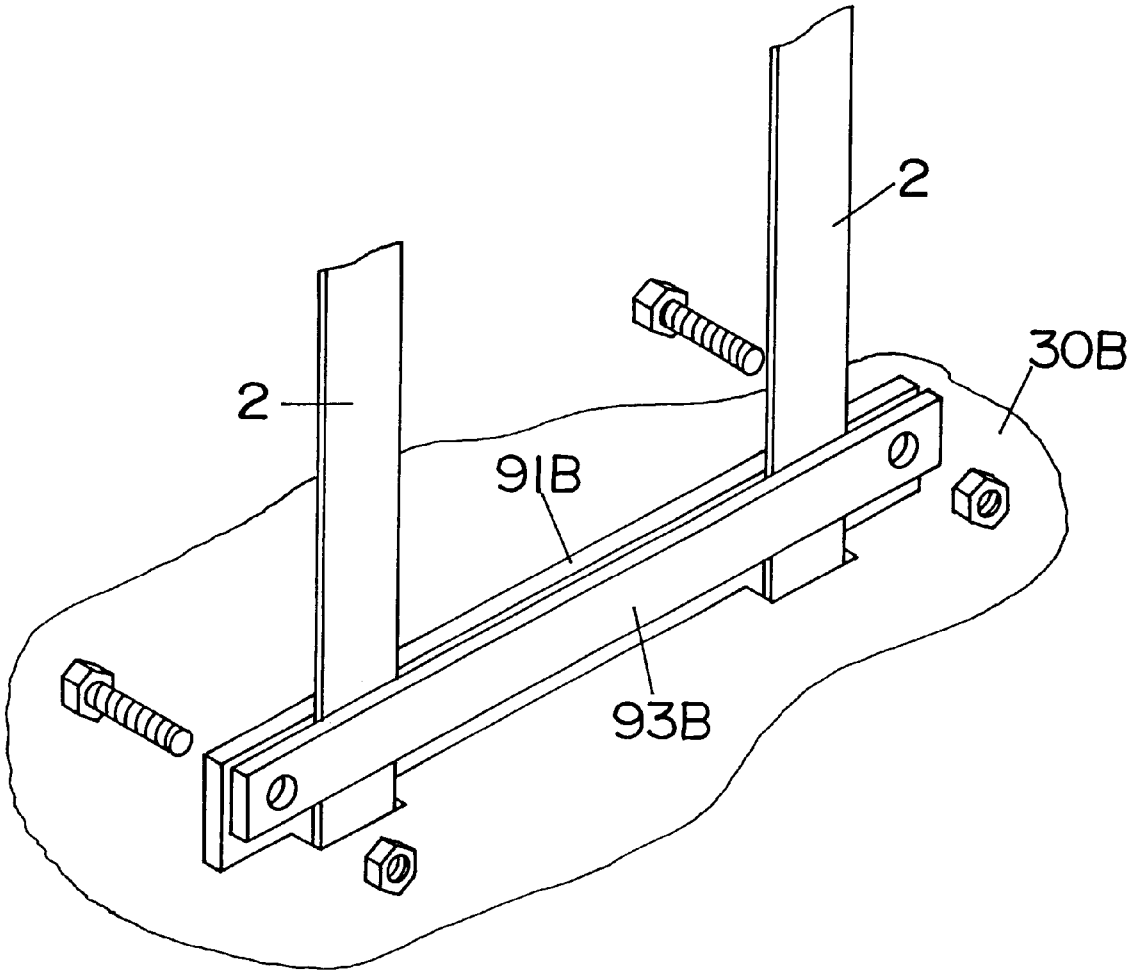
FIG. 22 is a partially perspective view showing a further modification of the cable-length adjust unit of the load holder.

In addition, FIG. 22 shows another modification of the first cable-length adjust unit of the load holder 3. In this modification, the cables 2 are caught between an elongate supporting member 93B and a cable catching portion 91B projected on the upper surface of a holder case 30B of the load holder. The supporting member 93B is fixed to the cable catching portion 91B by use of conventional bolts and nuts. According to this modification, the cables 2 can be tightly held by friction between the supporting member 93B and the cable catching portion 91B. In addition, it is possible to delicately adjust the winding amounts of the cables 2 on a winding shaft (not shown) rotatably supported in the holder case 30B. In these modifications shown in FIGS. 21 and 22, the other components of the first cable-length adjust unit are substantially same as the above embodiment.

In the above embodiment, the DC motor 22 and the winding drums 20 are mounted on the chassis 12 secured to the ceiling. However, these components of the drive unit may be mounted on the load holder. For example, in such a case, the load holder may have a lock mechanism for controlling unwinding of the cables from the winding drums housed in the load holder.

In conclusion, as understood from the above detailed explanation, the hoisting apparatus of the present invention has the following effects. Since the first cable-length adjust unit is housed in the load holder, it is possible to readily and safely adjust the length of the cable at the descending position of the load holder without operations at high elevations after the initial setup of the hoisting apparatus.

In addition, when a movement range of the load holder is controlled by use of a timer for setting a supply time of electric power to the motor, there is a problem that the load holder can not be repeatedly stopped at the same descending position due to variations in rotation speed of the motor. However, in the present invention, since the movement range of the load holder is controlled by use of the first and second cable-length adjust units, it is possible to stop the load holder at the same descending position with reliability regardless of the variations in rotation speed of the motor.

In particular, when the hoisting apparatus of the present invention is utilized for luminaires in high-ceilinged structures such as concert hall, gymnasium, and convention hall, it has great industrial significance in that maintenance of the luminaire can be efficiently performed under safe working conditions.

What is claimed is:

1. A hoisting apparatus comprising:

at least one cable;

a load holder for holding a load;

a base secured to a ceiling, and coupled to said load holder through said cable; and drive means for moving said load holder up and down by use of said cable between a top position where said load holder is located adjacent to said base and a bottom position where said load holder is spaced from said base by a distance;

wherein said load holder has cable-length adjust means for adjusting a length of said cable to stop said load holder at a desired position between said top and bottom positions.

2. The hoisting apparatus as set forth in claim 1, wherein one end of said cable is connected to said cable-length adjust means and an opposite end of said cable is connected to said drive means mounted to said base.

3. The hoisting apparatus as set forth in claim 1, wherein said cable is composed of a pair of strip cables.

4. The hoisting apparatus as set forth in claim 3, wherein said strip cables mutually extend in a substantially same plane.

5. The hoisting apparatus as set forth in claim 1, wherein said cable-length adjust means is provided with a winding shaft rotatably supported in said load holder and a rotation-inhibiting member for inhibiting the rotation of said winding shaft, and wherein one end of said cable is connected to said winding shaft, so that a desired amount of said cable can be wound on said winding shaft.

6. The hoisting apparatus as set forth in claim 5, wherein said winding shaft is divided into a pair of elongate pieces along its axial direction, and wherein one end of said cable is caught between said elongate pieces.

7. The hoisting apparatus as set forth in claim 5, wherein said winding shaft is formed with an operation part, which is accessible from outside of said load holder to adjust a winding amount of said cable on said winding shaft, and an engagement part, to which said rotation-inhibiting member can be engaged to prevent unwinding of said cable from said winding shaft.

8. The hoisting apparatus as set forth in claim 1, wherein said drive means is mounted to said base, and comprises a winding drum, to which one end of said cable is connected, and an electric motor for rotating said winding drum.

9. The hoisting apparatus as set forth in claim 8, wherein said base has second cable-length adjust means for adjusting an amount of said cable to be wound or unwound from said winding drum.

10. The hoisting apparatus as set forth in claim 9, wherein said second cable-length adjust means comprises a rotating body, which is rotated at a rotation amount of less than one turn according to the rotation of said winding drum when said load holder is moved from said top position to said bottom position, and a stop switch for automatically stopping a supply of electric power to said motor when said rotating body reaches the rotation amount.

11. The hoisting apparatus as set forth in claim 10, wherein said rotating body is a final gear coupled to said winding drum through reduction-gearing means, and wherein said final gear has a knob used to disengage said final gear from said reduction-gearing means and change the rotation amount of said rotating body.

12. The hoisting apparatus as set forth in claim 11, wherein said knob of said rotating body is exposed to be accessible from outside of said base.

13. The hoisting apparatus as set forth in claim 11, wherein said final gear receives a spring bias in its axial direction, and is moved in the axial direction against said spring bias to disengage said final gear from said reduction-gearing means and change the rotation amount of said rotating body.

14. The hoisting apparatus as set forth in claim 11, wherein said reduction-gearing means comprises a plurality of reduction gears engaged mutually, and a bearing unit for supporting rotation shafts of said reduction gears, and wherein said bearing unit is provided with a plurality of projections of different heights, each of which has at its top end a concave for receiving the rotation shaft of said reduction gear, and a single supporting member, which is used only to support one of said reduction gears in cooperation with said projection of the greatest height, so that the remaining reduction gears are supported by the other projections without using an additional supporting member.

15. The hoisting apparatus as set forth in claim 8, comprising cable receiving means provided to receive said cable at a position between said winding drum and said load holder, an elastic body for movably supporting said cable receiving means according to a change in tension of said cable, and a first switch for automatically stopping a supply of electric power to said motor when a positional displacement of the said cable receiving means is caused by an elastic deformation of said elastic body according to an increase in tension of said cable.

16. The hoisting apparatus as set forth in claim 15, said cable receiving means is a sheave for turning said cable unwound from said winding drum toward said load holder, said elastic body is a spring, and wherein the supply of electric power to said motor is stopped when said sheave is displaced downward by the elastic deformation of said spring.

17. The hoisting apparatus as set forth in claim 8, comprising brake means for inhibiting a rotation of a drive shaft of said motor when said load holder is in said top position.

18. The hoisting apparatus as set forth in claim 17, wherein said brake means comprises a pressure member of an elastic material, which is elastically deformed by said load holder when said load holder is in said top position, so that the deformed pressure member inhibits the rotation of the drive shaft of said motor by friction.

19. The hoisting apparatus as set forth in claim 8, comprising cable receiving means for turning said cable unwound from said winding drum toward said load holder, and a second switch for automatically stopping a supply of electric power to said motor when said second switch is activated by said cable itself extending between said winding drum and said cable receiving means.

20. The hoisting apparatus as set forth in claim 19, wherein said second switch is disposed in such a position that when a slack of said cable is caused by a decrease in tension of said cable, said second switch is activated by said cable itself under the slack condition.

21. The hoisting apparatus as set forth in claim 19, wherein said second switch is disposed in such a position that when unwinding of said cable from said winding drum is finished, said second switch is activated by said cable itself extending between said cable receiving means and said winding drum.

22. The hoisting apparatus as set forth in claim 8, wherein said winding drum has a cable catching portion for catching one end of said cable, and an arcuate portion configured to enhance winding of said cable on said winding drum only when said winding drum rotates in one direction.

23. The hoisting apparatus as set forth in claim 1, wherein said drive means comprises a winding drum, to which one end of said cable is connected, and a DC motor for rotating said winding drum, which comprises a permanent magnet and a rectifier brush.

24. The hoisting apparatus as set forth in claim 23, comprising reduction-gearing means for transmitting an output power of said DC motor to said winding drum, and wherein said reduction-gearing means has a self-lock mechanism for inhibiting transmission of a rotation of said winding drum to said DC motor, which is composed of a worm gear and a worm wheel.

25. The hoisting apparatus as set forth in claim 1, wherein said load holder has a case for housing said cable-length adjust means therein, which has a pair of guide projections formed such that said cable extends from said cable-length adjust means in said case toward said base through a clearance between said guide projections, and wherein at least one of said guide projections has a rounded tip.

26. The hoisting apparatus as set forth in claim 1, wherein said load holder is coupled to said base by use of plural cables, and has a case for housing said cable-length adjust means therein, and wherein said case has protrusions extending outside from its rim to prevent a situation in which said load holder suspended from said base by said cables is rotated about a horizontal axis by mistake to form a kink in said cables.

27. The hoisting apparatus as set forth in claim 26, wherein said base has a housing with a concave into which said case is fitted when said load holder is in said top position, and wherein each of said protrusions has an arcuate tip adapted to guide said case into said concave.

28. A hoisting apparatus, comprising:

a base;

drive means mounted to and housed within the base;

a load holder;

cable-length adjust means mounted to and housed within the load holder; and at least one cable extending to and between the base and the load holder, wherein one end portion of the cable is connected to the drive means and an opposite end portion of the cable is connected to the cable-length adjust means and each one of the drive means and the cable-length adjust means is operative to take in or let out the at least one cable from respective ones of the base and the load holder.

* * * * *